US008182169B2

(12) United States Patent
Thompson et al.

(10) Patent No.: US 8,182,169 B2
(45) **Date of Patent: *May 22, 2012**

(54) ENERGY ABSORBING VEHICLE BARRIER

(75) Inventors: Sean Thompson, Sacramento, CA (US); Samuel Ross Stanley, Jr., Pell City, AL (US); Patrick A. Leonhardt, Rocklin, CA (US); Donald C. Pyde, Schaumburg, IL (US)

(73) Assignee: Energy Absorption Systems, Inc., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/095,283

(22) Filed: Apr. 27, 2011

(65) Prior Publication Data

US 2011/0217115 A1 Sep. 8, 2011

Related U.S. Application Data

(63) Continuation of application No. 12/383,012, filed on Mar. 19, 2009, now Pat. No. 7,950,870.

(60) Provisional application No. 61/040,408, filed on Mar. 28, 2008, provisional application No. 61/115,814, filed on Nov. 18, 2008.

(51) Int. Cl.
*E01F 13/00* (2006.01)

(52) U.S. Cl. ..... 404/6; 404/9

(58) Field of Classification Search ..... 404/6, 9, 404/11; 256/13.1

See application file for complete search history.

(56) References Cited

U.S. PATENT DOCUMENTS

| | | | |
|---|---|---|---|
| 1,344,776 | A | 6/1920 | Strieter |
| 1,437,404 | A | 12/1922 | Donovan |
| 1,511,264 | A | 10/1924 | Carter |
| 1,661,051 | A | 2/1928 | Siano |
| 1,818,824 | A | 8/1931 | Strauss |

(Continued)

FOREIGN PATENT DOCUMENTS

EP 042 645 A2 12/1981

(Continued)

OTHER PUBLICATIONS

ASTM, "Standard Test Method for Vehicle Crash Testing of Perimeter Barriers," *ASTM Designation F 2656-07*, ASTM International, West Conshohocken, PA, 2007.

(Continued)

*Primary Examiner* — Raymond W Addie
(74) *Attorney, Agent, or Firm* — Brinks Hofer Gilson & Lione

(57) ABSTRACT

A non-lethal energy absorbing vehicle barrier for decelerating an impacting vehicle a gate member disposed between first and second gate receivers that is deformable from a pre-impact configuration to an impact configuration. The gate member may include a first deformable energy absorption member having a first end coupled to the first gate receiver and a second end extending inward toward a center of the gate member; a second deformable energy absorption member having a first end coupled to the second gate receiver and a second end extending inward toward the center of the gate member; and a deforming member connecting the first and second deformable energy absorption members in an overlapping configuration. The deforming member is configured to engage and deform the first and second deformable energy absorption members as the gate member is deformed from the pre-impact configuration to the impact configuration.

19 Claims, 22 Drawing Sheets

U.S. PATENT DOCUMENTS

| | | | |
|---|---|---|---|
| 1,929,859 | A | 10/1933 | Strauss |
| 2,043,525 | A | 6/1936 | Benedict |
| 2,189,974 | A | 2/1940 | Buford |
| 2,219,127 | A | 10/1940 | Buford |
| 2,237,106 | A | 4/1941 | Minert |
| 2,251,699 | A | 8/1941 | Banschbach |
| 2,336,483 | A | 12/1943 | Hoover |
| 2,391,275 | A | 12/1945 | Shaw |
| 2,440,574 | A | 4/1948 | Cotton |
| 2,465,936 | A | 3/1949 | Schultz |
| 2,483,655 | A | 10/1949 | Schultz |
| 2,578,903 | A | 12/1951 | Smith |
| 2,854,201 | A | 9/1958 | Cotton |
| 2,870,871 | A | 1/1959 | Stevinson |
| 2,979,163 | A | 4/1961 | Van Zelm et al. |
| 2,980,213 | A | 4/1961 | Van Zelm et al. |
| 3,017,163 | A | 1/1962 | Van Zelm et al. |
| 3,087,584 | A | 4/1963 | Jackson et al. |
| 3,132,721 | A | 5/1964 | Jackson |
| 3,143,321 | A | 8/1964 | McGehee et al. |
| 3,146,014 | A | 8/1964 | Kroell |
| 3,181,821 | A | 5/1965 | Webb |
| 3,195,685 | A | 7/1965 | Blackstone |
| 3,211,260 | A | 10/1965 | Jackson |
| 3,236,333 | A | 2/1966 | Mitchell |
| 3,301,351 | A | 1/1967 | Platus et al. |
| 3,307,832 | A | 3/1967 | Van Zelm et al. |
| 3,308,908 | A | 3/1967 | Bunn |
| 3,337,004 | A | 8/1967 | Hoffman et al. |
| 3,372,773 | A | 3/1968 | Russo et al. |
| 3,377,044 | A | 4/1968 | Jackson et al. |
| 3,451,319 | A | 6/1969 | Gubela |
| 3,486,791 | A | 12/1969 | Stoffel et al. |
| 3,547,468 | A | 12/1970 | Giuffrida |
| 3,561,690 | A | 2/1971 | Muskat |
| 3,604,285 | A | 9/1971 | Olsson |
| 3,638,913 | A | 2/1972 | Persicke |
| 3,674,115 | A | 7/1972 | Young et al. |
| 3,719,255 | A | 3/1973 | Daniels et al. |
| 3,730,586 | A | 5/1973 | Eggert |
| 3,738,599 | A | 6/1973 | Borehag |
| 3,768,781 | A | 10/1973 | Walker et al. |
| 3,810,595 | A | 5/1974 | Doolittle |
| 3,820,634 | A | 6/1974 | Poe |
| 3,827,660 | A | 8/1974 | Doolittle |
| 3,866,367 | A | 2/1975 | Strizki |
| 3,897,920 | A | 8/1975 | Di Giovanniantonio et al. |
| 3,938,763 | A | 2/1976 | DiGiovanniantonio |
| 3,944,187 | A | 3/1976 | Walker |
| 3,968,863 | A | 7/1976 | Reilly |
| 3,982,734 | A | 9/1976 | Walker |
| 4,027,905 | A | 6/1977 | Shimogawa et al. |
| 4,056,247 | A | 11/1977 | Bernard et al. |
| 4,102,518 | A | 7/1978 | Bernard et al. |
| 4,106,164 | A | 8/1978 | Lapp |
| 4,143,840 | A | 3/1979 | Bernard et al. |
| 4,150,805 | A | 4/1979 | Mazelsky |
| 4,200,310 | A | 4/1980 | Carney |
| 4,223,763 | A | 9/1980 | Duclos et al. |
| 4,289,419 | A | 9/1981 | Young et al. |
| 4,358,136 | A | 11/1982 | Tsuge et al. |
| 4,399,980 | A | 8/1983 | Van Schie |
| 4,452,431 | A | 6/1984 | Stephens et al. |
| 4,456,205 | A | 6/1984 | Alavoine et al. |
| 4,490,068 | A | 12/1984 | Dickinson |
| 4,509,577 | A | 4/1985 | Priefert |
| 4,574,523 | A | 3/1986 | Nasatka |
| 4,576,507 | A | 3/1986 | Terio |
| 4,583,716 | A | 4/1986 | Stephens et al. |
| 4,627,763 | A | 12/1986 | Roemer et al. |
| 4,630,395 | A | 12/1986 | Nasatka |
| 4,630,716 | A | 12/1986 | Faust |
| 4,699,197 | A | 10/1987 | Hamrick et al. |
| 4,715,742 | A | 12/1987 | Dickinson |
| 4,742,898 | A | 5/1988 | Lee |
| 4,762,439 | A | 8/1988 | Carlyle |
| 4,775,261 | A | 10/1988 | Fladung |
| 4,780,020 | A | 10/1988 | Terio |
| 4,784,515 | A | 11/1988 | Krage et al. |
| 4,809,933 | A | 3/1989 | Buzby et al. |
| 4,815,565 | A | 3/1989 | Sicking et al. |
| 4,818,137 | A | 4/1989 | Gorlov |
| 4,824,282 | A | 4/1989 | Waldecker |
| 4,826,349 | A | 5/1989 | Nasatka |
| 4,828,424 | A | 5/1989 | Crisp, Sr. |
| 4,844,213 | A | 7/1989 | Travis |
| 4,844,653 | A | 7/1989 | Dickinson |
| 4,850,737 | A | 7/1989 | Nasatka et al. |
| 4,893,119 | A | 1/1990 | Nasatka |
| 4,916,859 | A | 4/1990 | Butler |
| 4,923,327 | A | 5/1990 | Gorlov |
| 4,928,928 | A | 5/1990 | Buth et al. |
| 4,979,701 | A | 12/1990 | Colarik et al. |
| 4,989,835 | A | 2/1991 | Hirsh |
| 5,022,782 | A | 6/1991 | Gertz et al. |
| 5,074,391 | A | 12/1991 | Rosenzweig |
| 5,078,366 | A | 1/1992 | Sicking et al. |
| 5,118,056 | A | 6/1992 | Jeanise |
| H1133 | H | 2/1993 | Bridges et al. |
| 5,193,764 | A | 3/1993 | Larratt et al. |
| 5,228,237 | A | 7/1993 | Nasatka |
| 5,288,164 | A | 2/1994 | Nasatka |
| 5,310,277 | A | 5/1994 | Uotila |
| 5,332,071 | A | 7/1994 | Duncan |
| 5,391,016 | A | 2/1995 | Ivey et al. |
| 5,407,298 | A | 4/1995 | Sicking et al. |
| 5,487,562 | A | 1/1996 | Hedderly et al. |
| 5,547,309 | A | 8/1996 | Mak et al. |
| 5,597,055 | A | 1/1997 | Han et al. |
| 5,624,203 | A | 4/1997 | Jackson et al. |
| 5,634,738 | A | 6/1997 | Jackson et al. |
| 5,642,792 | A | 7/1997 | June |
| 5,762,443 | A | 6/1998 | Gelfand et al. |
| 5,775,675 | A | 7/1998 | Sicking et al. |
| 5,791,812 | A | 8/1998 | Ivey |
| 5,797,591 | A | 8/1998 | Krage |
| 5,823,705 | A | 10/1998 | Jackson et al. |
| 5,829,912 | A | 11/1998 | Marcotullio et al. |
| 5,902,068 | A | 5/1999 | Angley et al. |
| 5,924,680 | A | 7/1999 | Sicking et al. |
| 5,947,452 | A | 9/1999 | Albritton |
| 5,975,792 | A | 11/1999 | Goeken et al. |
| 5,993,104 | A | 11/1999 | Marcotullio et al. |
| 6,004,066 | A | 12/1999 | Niemerski |
| 6,024,383 | A | 2/2000 | Fohl |
| 6,062,765 | A | 5/2000 | Dotson |
| 6,082,926 | A | 7/2000 | Zimmer |
| 6,109,597 | A | 8/2000 | Sicking et al. |
| 6,115,963 | A | 9/2000 | Allardyce et al. |
| 6,119,399 | A | 9/2000 | McCain et al. |
| 6,131,873 | A | 10/2000 | Blazon et al. |
| 6,179,516 | B1 | 1/2001 | Ivey et al. |
| 6,203,079 | B1 | 3/2001 | Breed |
| 6,289,634 | B1 | 9/2001 | Allardyce et al. |
| 6,293,205 | B1 | 9/2001 | Butler |
| 6,293,727 | B1 | 9/2001 | Albritton |
| 6,308,309 | B1 | 10/2001 | Gan et al. |
| 6,308,809 | B1 | 10/2001 | Reid et al. |
| 6,312,188 | B1 | 11/2001 | Ousterhout et al. |
| 6,382,869 | B1 | 5/2002 | Dickinson |
| 6,394,241 | B1 | 5/2002 | Pesjardins et al. |
| 6,457,570 | B2 | 10/2002 | Reid et al. |
| 6,536,985 | B2 | 3/2003 | Albritton et al. |
| 6,651,386 | B2 | 11/2003 | Long |
| 6,668,989 | B2 | 12/2003 | Reid et al. |
| 6,719,483 | B1 | 4/2004 | Welandsson |
| 6,843,613 | B2 | 1/2005 | Gelfand et al. |
| 6,857,227 | B2 | 2/2005 | Russell |
| 6,962,245 | B2 | 11/2005 | Ray et al. |
| 7,014,388 | B2 | 3/2006 | Bibber |
| 7,063,364 | B2 | 6/2006 | Bird et al. |
| 7,083,357 | B2 | 8/2006 | Lamore |
| 7,118,304 | B2 | 10/2006 | Turpin et al. |
| 7,118,305 | B1 | 10/2006 | Corbett |
| 7,121,041 | B2 | 10/2006 | Anderson et al. |
| 7,125,197 | B2 | 10/2006 | Krewsun et al. |
| 7,140,802 | B2 | 11/2006 | Lamore |

| | | | |
|---|---|---|---|
| 7,185,882 | B2 | 3/2007 | Buth et al. |
| 7,195,419 | B2 | 3/2007 | Gelfand |
| 7,210,873 | B2 | 5/2007 | Gelfand |
| 7,249,909 | B2 | 7/2007 | Bibber |
| 7,264,417 | B1 | 9/2007 | Nasatka |
| 7,325,789 | B2 | 2/2008 | Buth et al. |
| 7,341,397 | B2 | 3/2008 | Murphy |
| 7,374,362 | B1 | 5/2008 | Metzger |
| 7,377,716 | B2 | 5/2008 | Gelfand |
| 7,396,184 | B2 | 7/2008 | LaTurner et al. |
| 7,441,983 | B2 | 10/2008 | Gelfand |
| 7,484,906 | B2 | 2/2009 | LaTurner et al. |
| 7,785,031 | B2 | 8/2010 | Vellozzi et al. |
| 7,832,957 | B2 | 11/2010 | Gelfand et al. |
| 7,845,877 | B2 | 12/2010 | Gelfand et al. |
| 2002/0085880 | A1 | 7/2002 | Schneider et al. |
| 2003/0002760 | A1 | 1/2003 | Tatsumura |
| 2003/0009944 | A1 | 1/2003 | Long |
| 2003/0016996 | A1 | 1/2003 | Gelfand et al. |
| 2003/0159356 | A1 | 8/2003 | Russell |
| 2003/0175076 | A1 | 9/2003 | Albritton |
| 2003/0235466 | A1 | 12/2003 | Krewsun |
| 2004/0033106 | A1 | 2/2004 | Turpin et al. |
| 2004/0141808 | A1 | 7/2004 | Allen et al. |
| 2004/0156677 | A1 | 8/2004 | Gelfand et al. |
| 2004/0228683 | A9 | 11/2004 | Gelfand et al. |
| 2005/0117967 | A1 | 6/2005 | Gelfand |
| 2005/0178065 | A1 | 8/2005 | Anderson et al. |
| 2005/0214072 | A1 | 9/2005 | Turpin et al. |
| 2005/0220536 | A1 | 10/2005 | Blair et al. |
| 2006/0002760 | A1 | 1/2006 | Vellozzi et al. |
| 2006/0008321 | A1 | 1/2006 | Bibber |
| 2006/0045618 | A1 | 3/2006 | Bibber |
| 2006/0104713 | A1 | 5/2006 | Gelfand et al. |
| 2006/0140717 | A1 | 6/2006 | Lamore |
| 2006/0151986 | A1 | 7/2006 | Reid et al. |
| 2006/0233607 | A1 | 10/2006 | Buckley et al. |
| 2006/0288643 | A1 | 12/2006 | Henshell |
| 2007/0101649 | A1 | 5/2007 | Anderson et al. |
| 2007/0140791 | A1 | 6/2007 | Gelfand |
| 2007/0160421 | A1 | 7/2007 | Gelfand |
| 2007/0223995 | A1 | 9/2007 | Nasatka |
| 2007/0237577 | A1 | 10/2007 | Gelfand et al. |
| 2008/0075529 | A1 | 3/2008 | Gelfand et al. |
| 2009/0129860 | A1 | 5/2009 | LaTurner et al. |
| 2009/0174200 | A1 | 7/2009 | LaTurner et al. |

FOREIGN PATENT DOCUMENTS

| | | | |
|---|---|---|---|
| EP | 283 939 | A2 | 9/1988 |
| EP | 283 939 | A3 | 9/1988 |
| EP | 286 782 | A1 | 10/1988 |
| EP | 328 919 | A3 | 1/1989 |
| EP | 306 595 | A1 | 3/1989 |
| EP | 328 919 | A2 | 8/1989 |
| EP | 503 906 | A1 | 9/1992 |
| EP | 808 948 | A2 | 11/1997 |
| GB | 2 014 220 | A | 8/1979 |
| GB | 2 229 472 | A | 9/1990 |
| GB | 2 367 085 | A | 3/2002 |
| JP | 2000-248514 | A | 9/2000 |
| WO | WO 89/10302 | A1 | 11/1989 |
| WO | WO 90/02229 | A1 | 3/1990 |
| WO | WO 90/05809 | A1 | 5/1990 |
| WO | WO 92/02688 | A1 | 2/1992 |
| WO | WO 97/15729 | A1 | 5/1997 |
| WO | WO 97/41307 | A1 | 11/1997 |
| WO | WO 97/47495 | A1 | 12/1997 |
| WO | WO 98/44203 | A1 | 10/1998 |
| WO | WO 00/68594 | A1 | 11/2000 |
| WO | WO 03/102402 | A2 | 12/2003 |
| WO | WO 2005/045135 | A1 | 5/2005 |
| WO | WO 2005/103388 | A1 | 11/2005 |
| WO | WO 2006/010122 | A2 | 1/2006 |
| WO | WO 2006/010122 | A3 | 1/2006 |
| WO | WO 2006/055210 | A2 | 5/2006 |
| WO | WO 2006/055210 | A3 | 5/2006 |
| WO | WO 2006/104458 | A1 | 10/2006 |
| WO | WO 2007/071725 | A1 | 6/2007 |

OTHER PUBLICATIONS

Energy Absorption Systems, Inc., Quest™ Impact Attenuator, NCHRP 350, 1 page.

Ross, H.E. et al., "Recommended Procedures for the Safety Performance Evaluation of Highway Features," *National Cooperative Highway Research Report 350,* Transportation Research Board, Washington, D.C., 1993.

Safety Trailers, Inc. TTMA-100, Exclusive Distributor for STI TTMA-100, http://gsihighway.com/safetytrailers.htm, obtained Jun. 27, 2007, 2 pages.

Safety Trailers, Inc., *TTMA in tow—no need to stow, use at any speed*, www.safetytrailers.com, 3 pages.

Safety Trailers, Inc., TTMA-100—Trailer TMA General Specifications, 5 pages.

"Technical Summary of the TTMA-100," date unknown, 1 page.

U.S. Department of State, "Test Method for Vehicle Crash Testing of Perimeter Barriers and Gates," *Department of State Standard SD-STD-02.01, Revision A*, Bureau of Diplomatic Security, Washington, D.C., 2003.

Vägverket, *Pocket Facts 2006, Swedish Road Administration, Roads and Traffic*, Publication 2006:23E, 52 pages.

M. H. Ray et al., "Side Impact Crash Testing", Report FHWA-RD-92-052, Test No. 91S046, Mar. 1992, Federal Highway Admin., McLean, VA., pp. 1-34.

M. H. Ray et al., "Side Impact Crash Test and Evaluation Procedures for Roadside Structure Crash Test", Report FHWA-RD-92-062, May 1993, Fed. Hwy. Admin., McLean, VA., pp. 1-28.

M. H. Ray et al., "Side Impact Crash Testing of Roadside Structures", Report FHWA-RD-92-079, May 1993, Fed. Hwy. Admin., McLean, VA., pp. 1-78.

M. H. Ray et al., "Severity Measures in Side-Impacts with Narrow Roadside Structures", J. Transportation Eng., 120(2):322-338, Mar.-Apr. 1994.

M. H. Ray et al., "Test and Evaluation Criteria for Side—Impact Roadside Appurtenance Collisions", J. Transportation Eng., 120(4):633-651, Jul.-Aug. 1994.

M. H. Ray et al., "Side Impact Crash Test and Evaluation Criteria for Roadside Safety Hardware", General Design and Roadside Safety Features, Transportation Research Record No. 1647, T.R.B., Washington, D.C., pp. 1-17, Jan. 1998.

M. H. Ray et al., "Evaluating Human Risk in Side Impact Collisions with Roadside Objects", Paper No. 00/0250, Transportation Research Board 79$^{th}$ Annual Meeting, Washington, DC, Jan. 9-13, 2000, pp. 1-16.

B. G. Pfeifer et al., "Development of a Metal Cutting W-Beam Guardrail Terminal", Transportation Research Report TRP-03-43-94, Sep. 1994, Fed. Hwy. Admin., 57 pages.

Road Systems, Inc.—BEAT & BEAT-MT, "BEAT Box Beam Bursting Energy Absorbing Terminals", obtained at the internet address http://www.roadsystems.com/beat.htm, 2 pages, Jan. 2004.

Road Systems, Inc.—FLEAT, "How the FLEAT Functions" obtained at the internet address http://www.roadsystems.com/fleat.htm, 2 pages, Jan. 2004.

Road Systems, Inc.—SKT, "How the SKT Functions" obtained at the internet address http://www.roadsystems.com/skt.htm, 2 pages, Jan. 2004.

Road Systems, Inc.—FLEAT-MT, "How the FLEAT-MT Functions" obtained at the internet address http://www.roadsystems.com/fleatmt.htm, 1 page, Jan. 2004.

Trinity Industries, Inc., "Products-Taking Highway Safety Into the 21$^{st}$ Century!, TRACC Family", obtained at the internet address http://www.highwayguardrail.com/Products%20-%20TRACC%20-FAMILY.html 4 pages, Jan. 2004.

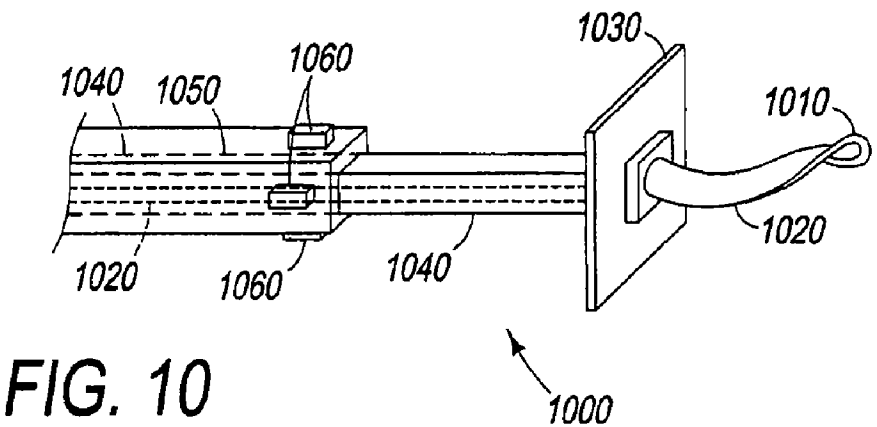
FIG. 10
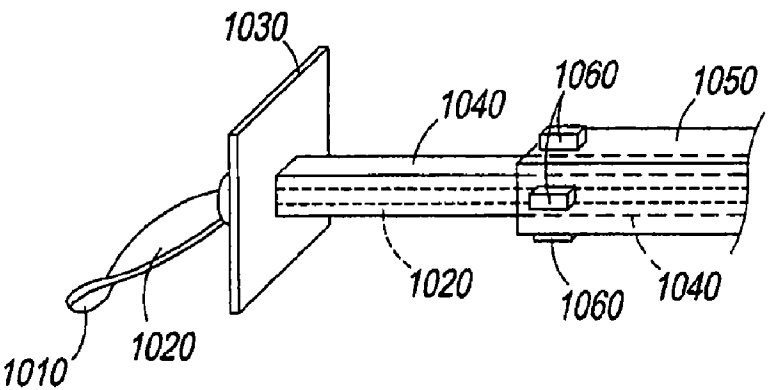

ENERGY ABSORBING VEHICLE BARRIER

RELATED APPLICATION

This application is a continuation of U.S. patent application Ser. No. 12/383,012, filed Mar. 19, 2009 now U.S. Pat. No. 7,950,870, which claims the benefit of U.S. Provisional Application No. 61/040,408, filed on Mar. 28, 2008, and U.S. Provisional Application No. 61/115,814, filed on Nov. 18, 2008, the entire disclosures of which are hereby incorporated herein by reference.

BACKGROUND

1. Field of the Invention

The present invention generally relates to a vehicle barrier, and in particular, a vehicle barrier capable of absorbing energy of an impacting vehicle in a non-lethal manner.

2. Technical Background

Maintaining the security of sensitive government facilities and the like from terrorist attack or unauthorized entry is of great concern. In particular, concern over motor vehicle based terrorist attacks and the like have led to a "security first" mentality in the development and production of security gates and barriers. The primary goal of such "security first" gates and barriers is to prevent an unauthorized vehicle or vehicles from penetrating the secured area, and to maximize the distance between a potentially explosive laden vehicle and the facility. As such, most such security devices are typically designed without regard to the safety of the occupants of an impacting vehicle, and are generally considered to be lethal. In fact, the lethality of such devices to the driver of the impacting vehicle may be considered to be a secondary benefit in some circumstances.

However, conventional security gates and barriers fail to consider the errant driver that mistakenly collides with the device. Unfortunately, collisions between errant drivers and security gates and barriers are not rare events. Errant drivers may impact security gates and barriers for a variety of reasons, such as being lost, being distracted by mobile phones or the like, or being impaired by drugs or alcohol.

Thus, a need presently exists for an improved security gate that is capable of effectively preventing unauthorized or unwanted vehicles from penetrating a secure area in a non-lethal manner.

BRIEF SUMMARY

In one aspect, an energy absorbing vehicle barrier includes a first gate receiver and a second gate receiver laterally spaced apart from the first gate receiver. The first and second gate receivers are adapted to be disposed on opposite sides of a vehicle pathway. A gate member is disposed between the first and second gate receivers and is deformable from a pre-impact configuration to an impact configuration.

The gate member may include a first deformable energy absorbing member having a first end coupled to the first gate receiver and a second end extending laterally inward toward a center of the gate member. The gate member may also include a second deformable energy absorbing member having a first end coupled to the second gate receiver and a second end extending laterally inward toward the center of the gate member. A first deforming member is configured to engage and deform the first deformable energy absorbing member as the gate member is deformed from the pre-impact configuration to the impact configuration, and a second deforming member is configured to engage and deform the second deformable energy absorbing member when the gate member is deformed from the pre-impact configuration to the impact configuration. The first and second energy absorbing members may be connected by a frangible member.

In another aspect, the first and second deformable energy absorbing members may include a stop member configured to engage and stop the deforming members from deforming the deformable energy absorbing members as the gate member is deformed from the pre-impact configuration.

In yet another aspect, the first and second energy absorbing members may comprise a first region having a first energy absorbing capacity and a second region having a second energy absorbing capacity. The second energy absorbing capacity may be greater than the first energy absorbing capacity.

In another aspect, the gate member includes a first support member and a second support member. The first and second support members are movable from a retracted position to a deployed position. In the retracted position, the gate member and the first and second support members are disposed so as not to impede vehicular traffic on the vehicle pathway and the first and second support members are not coupled to the first and second gate receivers. In the deployed position, the gate member and the first and second support members are disposed to impede vehicular traffic on the vehicle pathway and the gate member is coupled to the first and second gate receivers. The gate member may be moved from the retracted position to the deployed position by one or more deployment units.

The first support member may be frangibly coupled to a first deployment unit, and the second support member may be frangibly connected to the second deployment unit. The first and second support members are configured to decouple from the first and second deployment units when the gate member deforms from the pre-impact configuration to the impact configuration.

In yet another aspect, the gate member also includes a plurality of tether members connecting the deforming members. The gate member may include a restraint member coupling the first and second tethers. The restraint member is configured to restrain relative vertical movement between the first and second tethers when the gate member is deformed from the pre-impact configuration to the impact configuration.

In another aspect, the gate member may include a cover member and a plurality of cover support members supporting the cover member when the gate is in a retracted position and a vehicle is traveling through the vehicle pathway.

In one embodiment, an energy absorbing vehicle barrier may include a gate member disposed between first and second gate receivers. The gate member may be deformable from a pre-impact configuration to an impact configuration. The gate member may include a first deforming tube having a first end coupled to the first gate receiver and a second end extending inward toward a center of the gate member; a second deforming tube having a first end coupled to the second gate receiver and a second end extending inward toward the center of the gate member; and a deformable energy absorption member connecting the first and second deforming tubes in an overlapping configuration. The first and second deforming tubes may include deforming members configured to engage and deform the deformable energy absorption member as the gate member is deformed from the pre-impact configuration to the impact configuration.

In one aspect, the energy absorbing vehicle barrier may include a tether disposed within the first and second deforming tubes and the deforming tube. The tether may have a first end coupled to the first gate receiver and a second end coupled to the second gate receiver.

In another embodiment, the energy absorbing vehicle barrier may include a gate member disposed between first and second gate receivers that is deformable from a pre-impact configuration to an impact configuration. The gate member may include a first deformable energy absorption member having a first end coupled to the first gate receiver and a second end extending inward toward a center of the gate member; a second deformable energy absorption member having a first end coupled to the second gate receiver and a second end extending inward toward the center of the gate member; and a deforming member connecting the first and second deformable energy absorption members in an overlapping configuration. The deforming member is configured to engage and deform the first and second deformable energy absorption members as the gate member is deformed from the pre-impact configuration to the impact configuration.

The energy absorbing vehicle barrier may include a tether disposed within the first and second deformable energy absorption members. The tether may have a first end coupled to the first gate receiver and a second end coupled to the second gate receiver.

A method of arresting an impacting vehicle may include pivoting a first gate member and a second gate member from a retracted position to a deployed position. The first gate member has a first height in the deployed position and the second gate member has a second height in the deployed position, and the second gate member is disposed downstream of the first gate member. When the first and second gate members are impacted, the first and second gate members absorb energy.

Another method of arresting an impacting vehicle may include providing a gate member comprising first and second deformable energy absorbing members, and first and second deforming members; moving the gate member from a retracted position to a deployed position, where the gate member is disposed so as not to impede vehicular traffic on a vehicle pathway in the retracted position, and the gate member is disposed to impede the vehicular traffic on the vehicle pathway in the deployed position; successively impacting the gate member; and deforming the first and second deformable energy absorbing members with the first and second deforming members in at least an inboard direction.

In another embodiment, an energy absorbing vehicle barrier system includes a first pair of gate receivers spaced laterally apart. The first and second gate receivers are adapted to be disposed on opposite sides of a vehicle pathway. A second pair of gate receivers is spaced laterally apart and the first and second gate receivers are adapted to be disposed on opposite sides of the vehicle pathway. The second pair of gate receivers is disposed downstream of the first pair of gate receivers. A first gate member is disposed between, and coupled to the first pair of gate receivers, the first gate member having a first height. A second gate member is disposed between and coupled to the second pair of gate receivers, the second gate member having a second height. The second height may be greater than the first height, and the first and second gate members may be pivotable between a retracted position and a deployed position.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

BRIEF DESCRIPTION OF THE DRAWINGS

FIG. 4(*a*) is a close-up perspective view of a receiver interface portion of the primary gate member of FIG. 4.

FIG. 4(*b*) is a close-up perspective view of a central portion of the primary gate member of FIG. 4.

FIG. 5(*a*) is a close-up perspective view of a receiver interface portion of the secondary gate member of FIG. 5.

FIG. 5(*b*) is a close-up perspective view of a central portion of the primary gate member of FIG. 5.

FIG. 10 is a perspective view of an embodiment of an energy absorption assembly.

FIG. 15(*b*) is a partial cross-sectional view of the deployment assembly of FIG. 15(*a*) in the deployed position.

FIG. 15(*c*) is a perspective view of the deployment assembly of FIG. 15(*a*) in a retracted position.

FIG. 15(*d*) is a partial cross-sectional view of the deployment assembly of FIG. 15(*a*) in the retracted position.

DETAILED DESCRIPTION OF THE DRAWINGS AND THE PRESENTLY PREFERRED EMBODIMENTS

Figure 1:
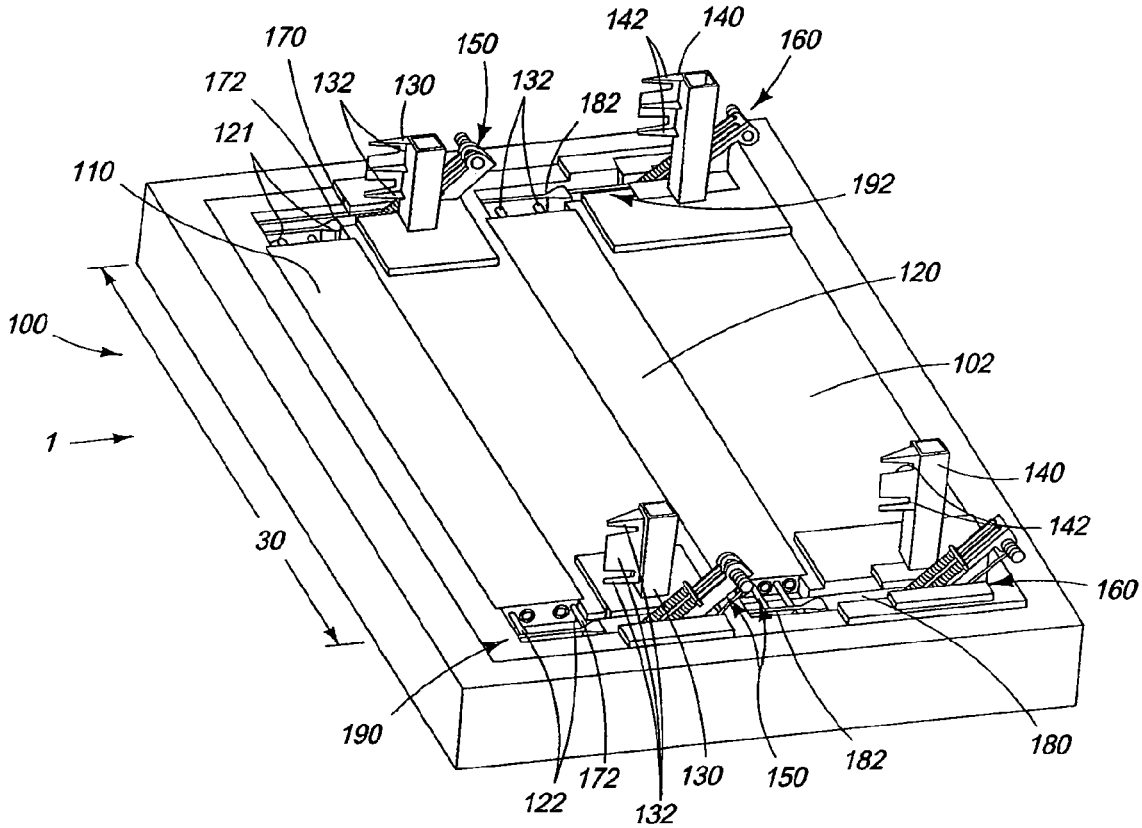
FIG. 1 is a perspective view of an embodiment of an energy absorbing vehicle barrier in a retracted position.

The term "lateral," "laterally," and variations thereof refer to the widthwise direction 30 between the primary or secondary gate receivers 130, 140, and perpendicular to the impact direction 1. The terms "downstream" and "rearward" refer to the position or orientation moving away from the primary gate assembly 10 and toward the secondary gate assembly 20 in the impact direction 1, while the terms "upstream" or "forward" refer to the position or orientation moving toward the primary gate assembly 10 and away from the secondary gate assembly 20 in a direction opposite the impact direction 1. The term "outboard" refers to the direction or orientation towards the laterally outermost edges of the primary or secondary gate deployment assemblies 150, 160 of the energy absorbing vehicle barrier 100, while the term "inboard" refers to the direction or orientation away from the outermost edges and towards the lateral center of the primary and secondary gate members 110, 120 of the energy absorbing vehicle barrier 100. Therefore, for example, a component positioned inboard of another component is closer to the lateral center of the primary or secondary gate members 110, 120, and away from the primary or secondary gate deployment assemblies 150, 160, and vice versa, a component positioned outboard of another component is closer to the primary or secondary gate deployment assemblies 150, 160, and away from the lateral center of the primary or secondary gate members 110, 120. The term "upper" or "above" refers to the vertical direction or orientation towards the top most edge of the energy absorbing vehicle barrier 100, while the term "lower" or "below" refers to the vertical direction or orientation towards the ground. The term "overlapping configuration" may mean overlapping in an inside or outside configuration. The term tether refers to any connecting member, including, for example and without limitation, cables, or straps made of metal, Kevlar, Nylon or the like, and including various flexible members capable of being put in tension.

Figure 2:
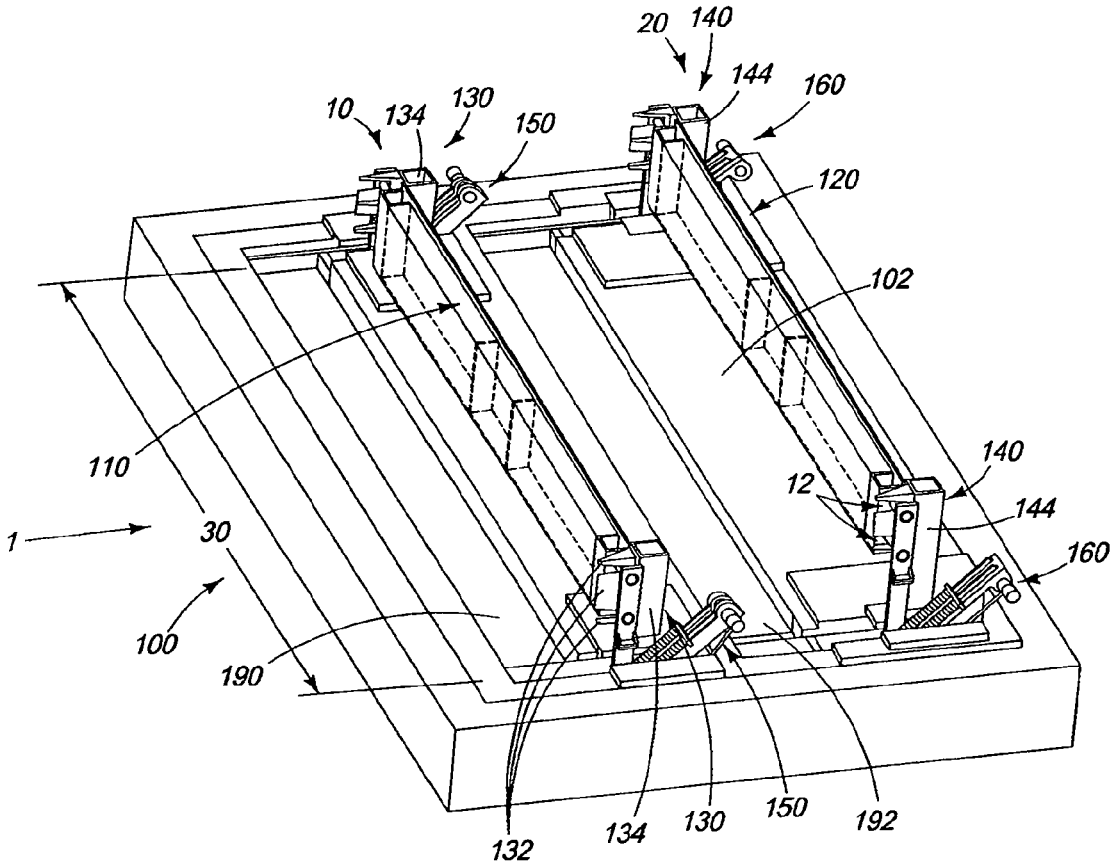
FIG. 2 is a perspective view of the energy absorbing vehicle barrier of FIG. 1 in a deployed position.

Turning now to the drawings, FIGS. 1-5(*b*) illustrate an energy absorbing vehicle barrier 100 incorporating preferred embodiments of this invention. Referring to FIGS. 1 and 2, the energy absorbing vehicle barrier 100 includes a primary barrier assembly 10, a secondary barrier assembly 20, and a foundation 102 having a primary barrier recess 190 and a secondary barrier recess 192. The primary barrier assembly 10 includes a pair of primary gate receivers 130, a pair of primary gate deployment assemblies 150, and a pair of lower gate support members 170. Each of the lower gate support members 170 includes a mounting plate 176.

Each of the primary gate receivers 130 includes receiver arms 132. The primary barrier assembly 10 also includes a primary gate member 110 having two pairs of receiver interface members 122 and a pair of upper primary gate support members 172. Each of the upper primary gate support members 172 includes a mounting plate 174.

The secondary barrier assembly 20 includes a pair of secondary gate receivers 140, a pair of secondary gate deployment assemblies 160, and a pair of lower secondary gate support members 180. The primary and secondary receivers 130, 140 may act as anchor members. Each of the primary gate receivers 140 includes receiver arms 142, and each of the lower gate support members 180 includes a mounting plate 176. The secondary barrier assembly 20 also includes a secondary gate member 120 having two pairs of receiver interface members 132 and a pair of upper secondary gate support members 182. Each of the upper secondary gate support member 182 includes a mounting plate 174.

Figure 3:
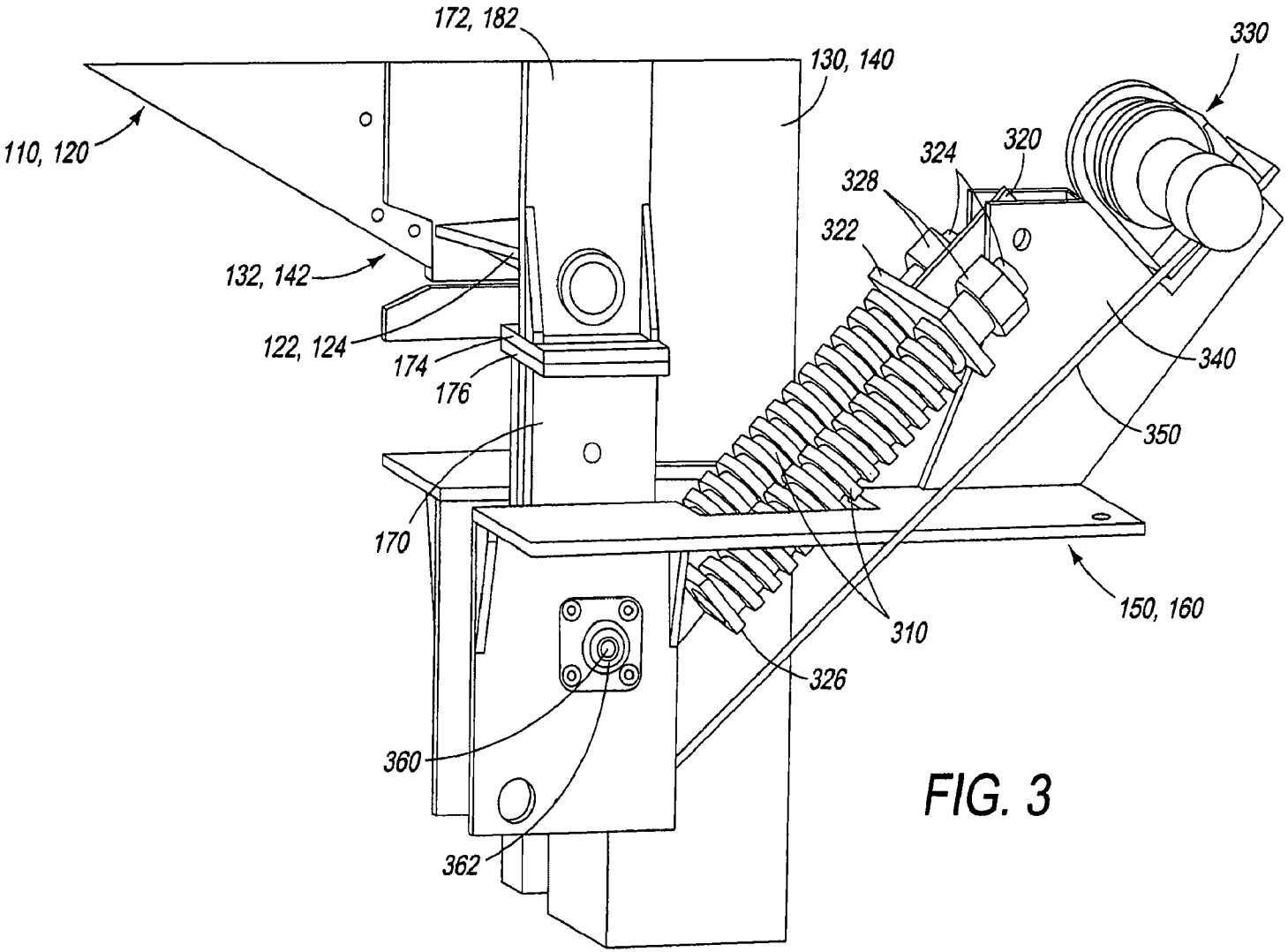
FIG. 3 is a close up perspective view of a deployment assembly of the energy absorbing vehicle barrier of FIG. 1.

FIG. 3 is a close-up view of one of the two primary gate deployment assemblies 150 for the primary barrier assembly 10. The deployment assembly 150 includes a pair of springs 310, a pair of guides 324, a spring anchor 326, retention fasteners 328, a winch 330, a winch support member 340, a cable 350, an axle 360, and a connector member 320 having a spring reaction plate 322. Each axle 360 preferably includes four bearings, however, it should be understood that each axle 360 may include more or fewer than four bearings. Note that the two primary gate deployment assemblies 150 for the primary barrier assembly 10 are identical in components and function, but are assembled in a mirror image configuration. Furthermore, the two secondary gate deployment assemblies 160 for the secondary barrier assembly 20 include substantially the same components and function in the same manner as the primary gate deployment assembly 150 shown in FIG. 3.

Figure 4:
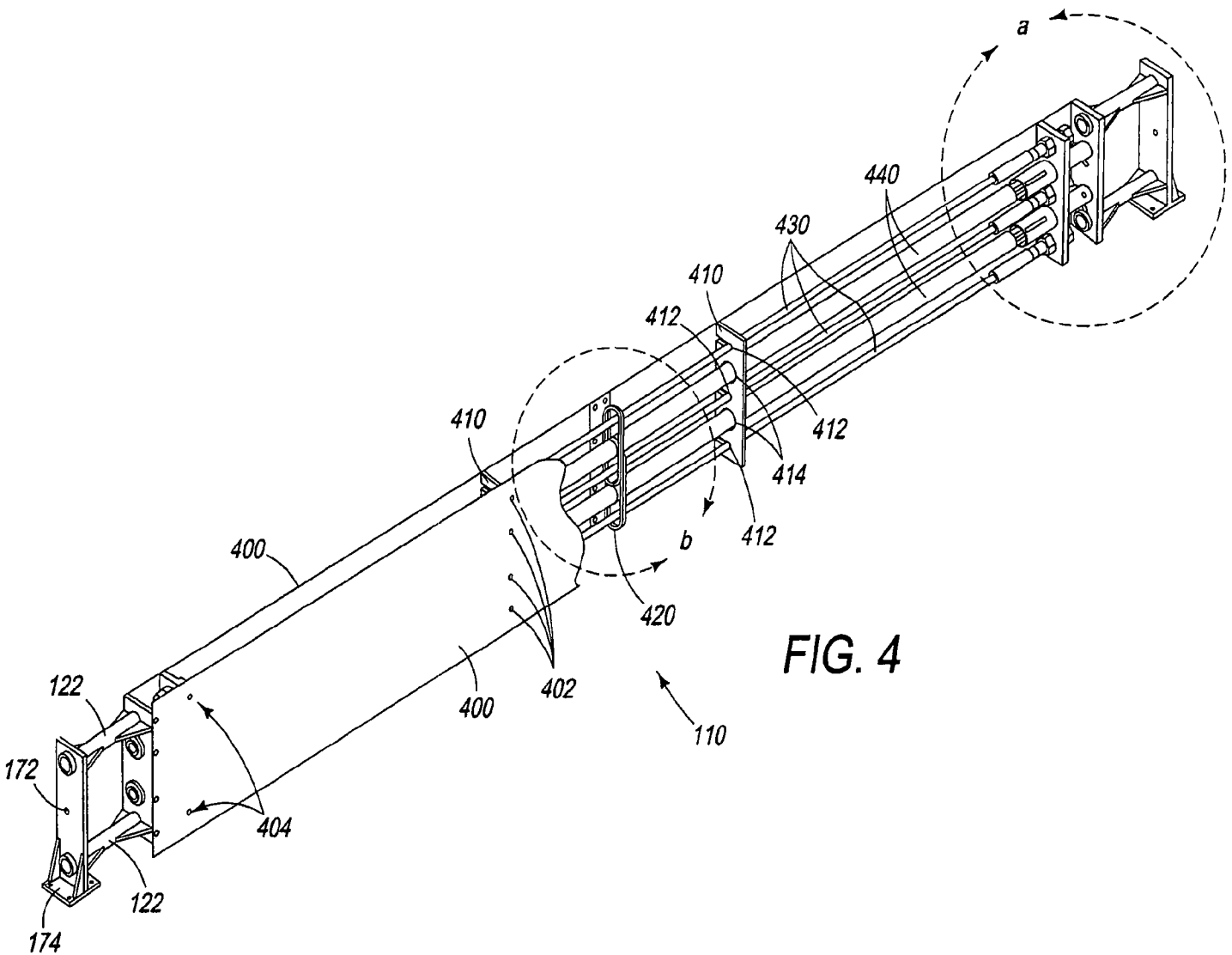
FIG. 4 is a perspective view of a primary gate member of the energy absorbing vehicle barrier of FIG. 1.
Figure 4A:
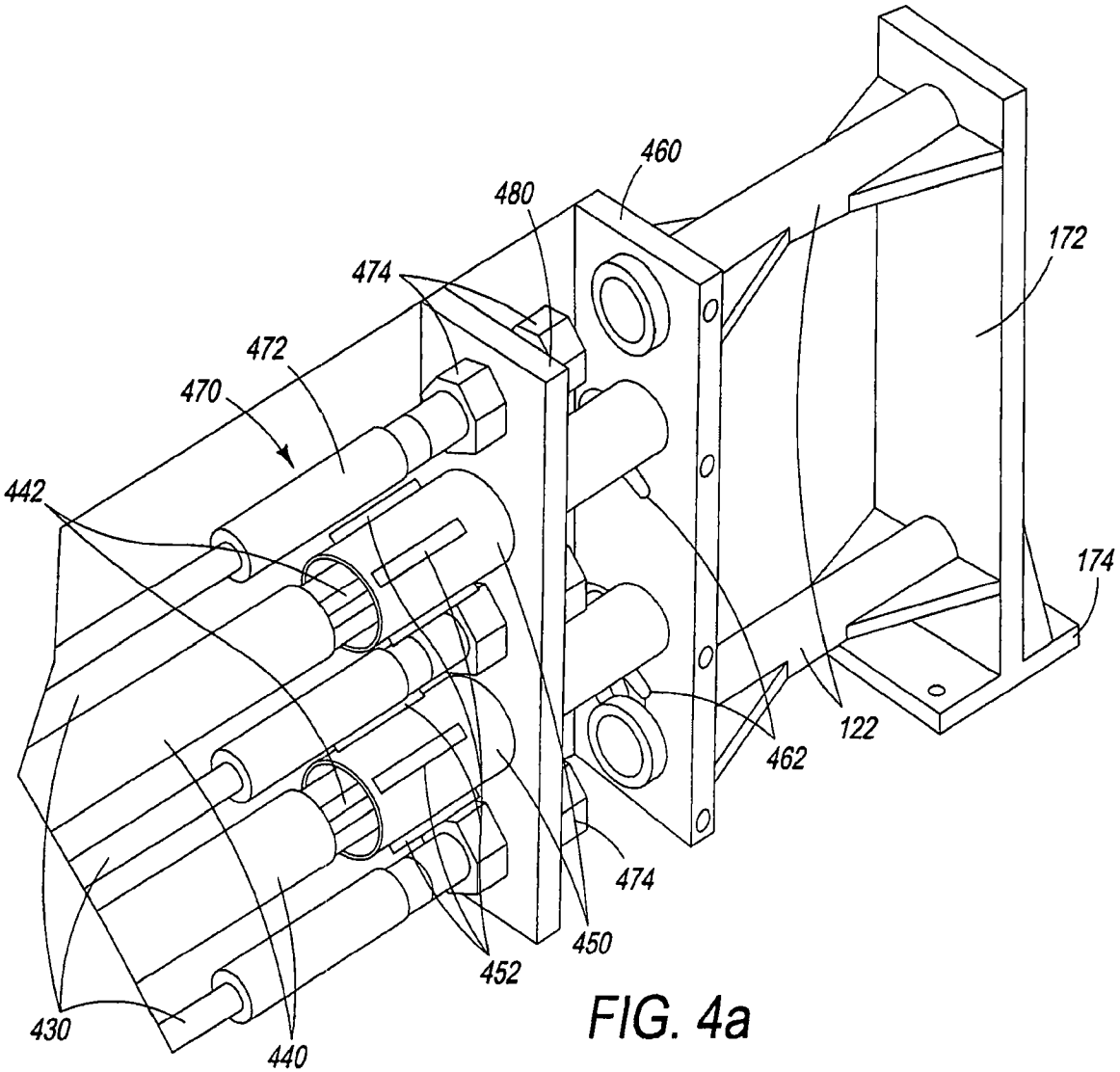
Figure 4B:
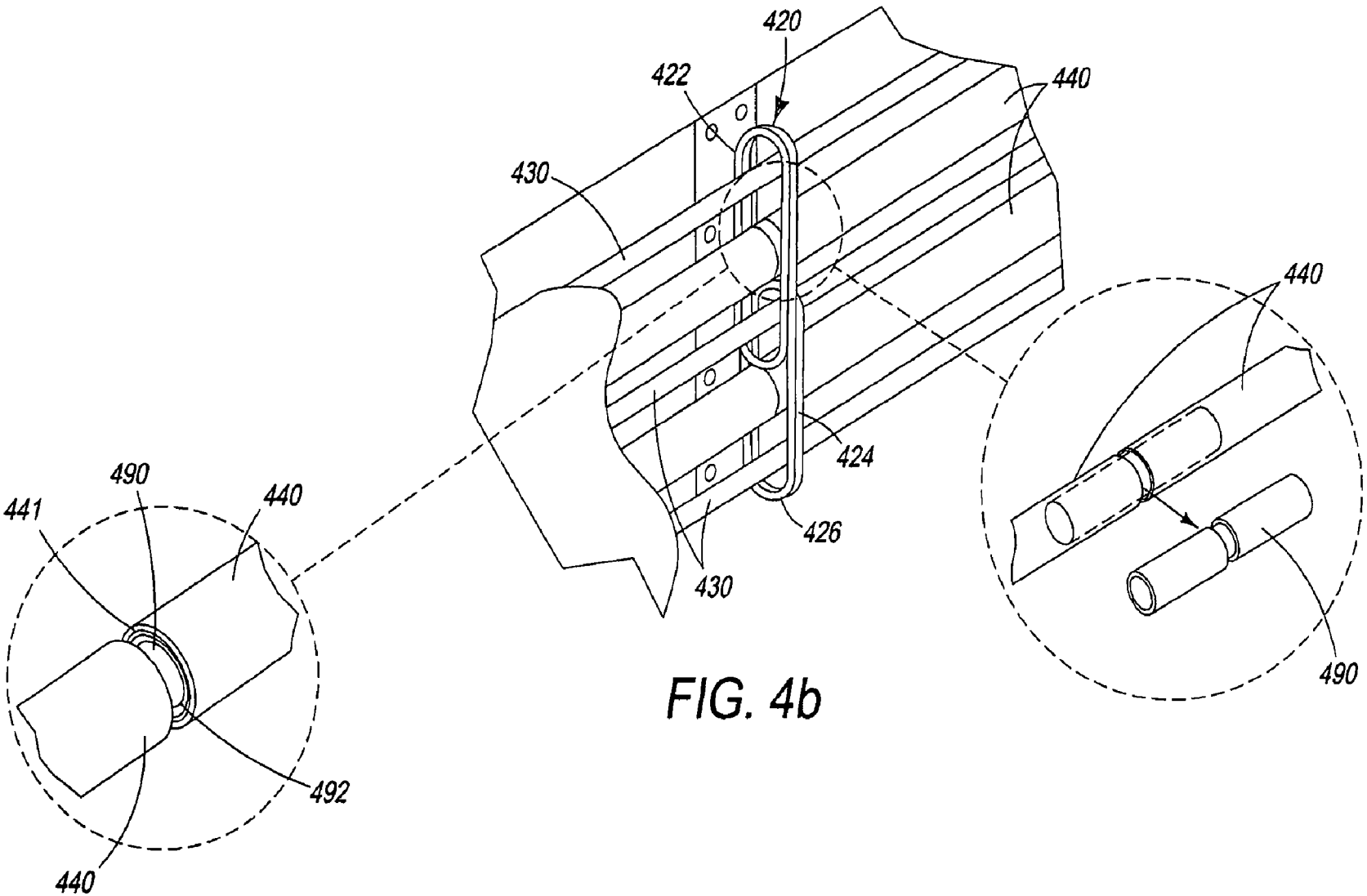

Referring to FIG. 4, the primary gate member 110 includes covers 400, fasteners 402, shearable fasteners 404, three vehicle retention tethers 430, and two pairs of deformable energy absorbing members 440. The primary gate member 110 preferably includes at least two spacing support members 410, each spacing support member 410 having three tether notches 412 and two receiver holes 414. However, it should be understood that the primary gate member 110 may include more than two spacing support members 410. Further, it should be understood that the primary gate member 110 may include more than or less than three vehicle retention tethers 430 or more or less than two pairs of deformable energy absorbing members 440.

As shown in FIG. 4(*a*), each of the deformable energy absorbing members 440 has a preformed portion 442. The primary gate member 110 preferably includes four deforming collars 450, a deformable energy absorbing member anchor 460, two anchor pins 462, three tether anchor assemblies 470, and a tether anchor plate 480. Each of the tether assemblies 470 includes a tether anchor 472 and fasteners 474, and each of the deforming collars 450 preferably includes four deforming members 452. However, it should be understood that the gate member is not limited to four deforming collars 450, and each of the deforming collars 450 are not limited to having four deforming members 452. The primary gate member may include more or fewer than four deforming collars 450, and each deforming collar may have more or fewer than four deforming members 452.

Turning to FIG. 4(*b*), the primary gate member 110 further includes a joiner member 490 having an outer surface 492, and a tether restraint 420. The tether restraint 420 preferably includes a first restraint 422, a second restraint 424 and a third restraint 426.

Figure 5:
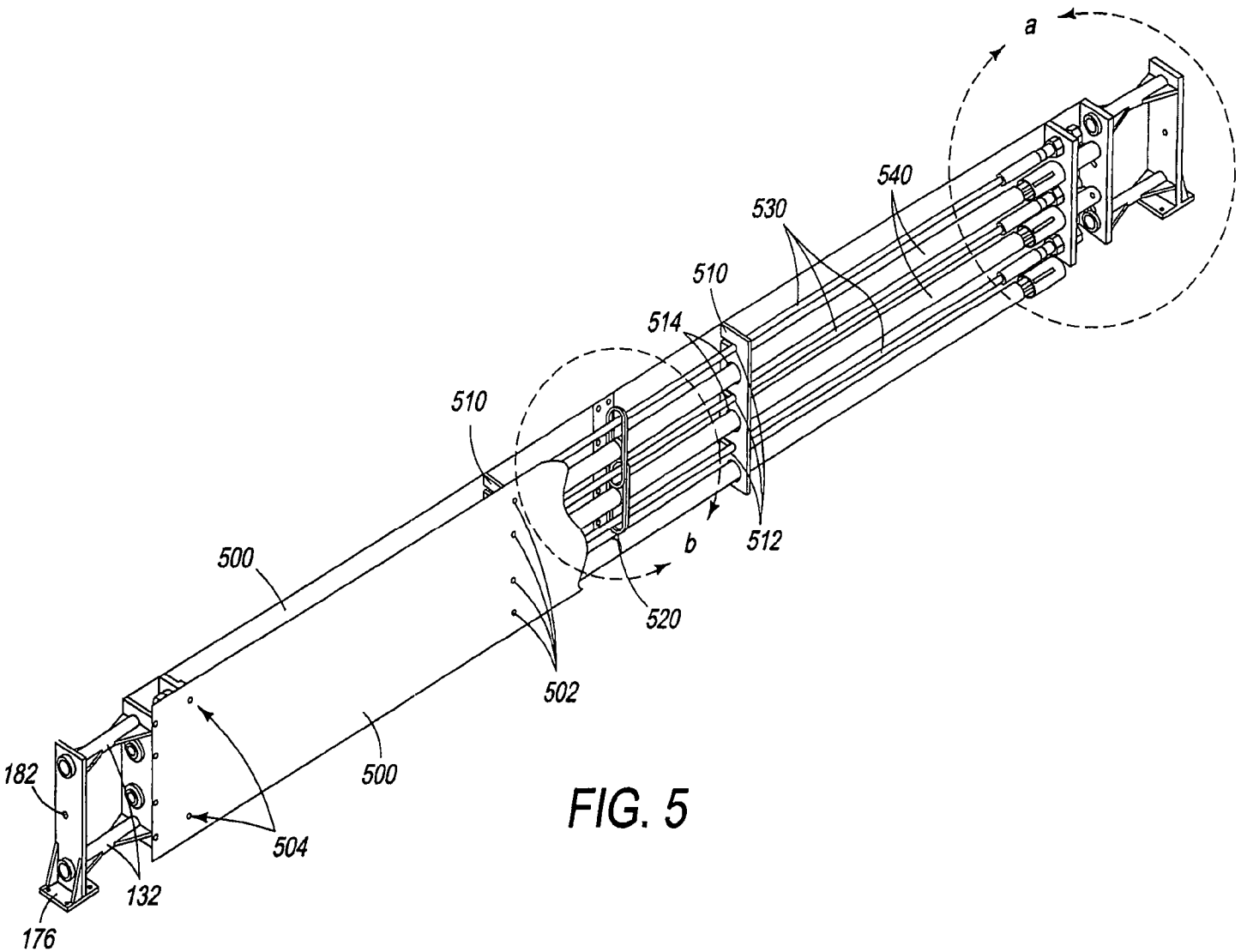
FIG. 5 is a perspective view of a secondary gate member of the energy absorbing vehicle barrier of FIG. 1.
Figure 5A:
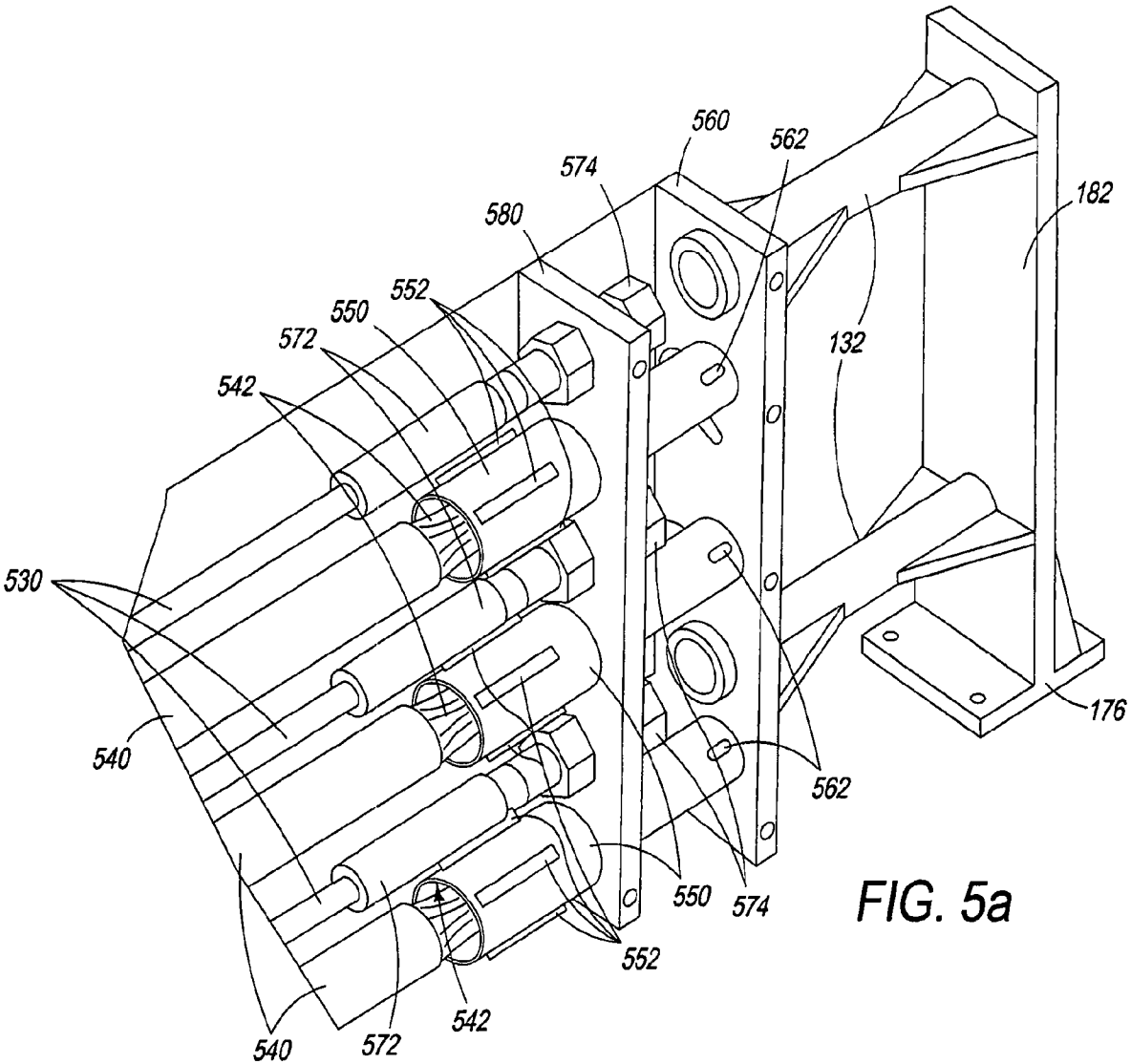
Figure 5B:
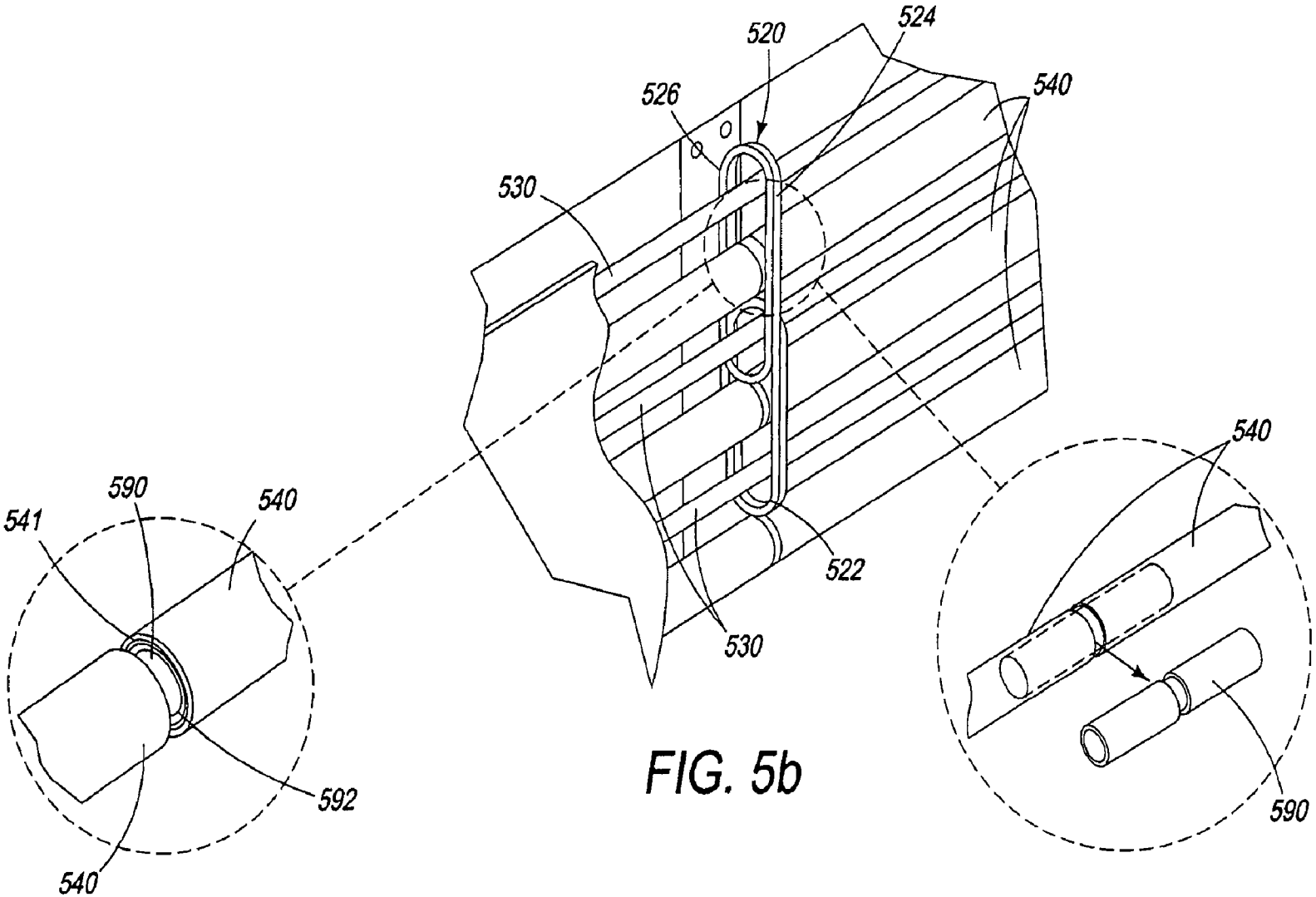

Referring to FIG. 5, the secondary gate member 120 preferably includes two covers 500, fasteners 502, shearable fasteners 504, three vehicle retention tethers 530, and three pairs of deformable energy absorbing members 540. The secondary gate member 120 preferably includes at least two spacing support members 510, each spacing support member 510 having three tether notches 512 and three receiver holes 514. However, as with primary gate member 110, it should be understood that the secondary gate member 120 may include more than two spacing support members 510, and more or less than three vehicle retention tethers 530 or three pairs of deformable energy absorbing members 540.

As shown in FIG. 5(*a*), each of the deformable energy absorbing members 540 has a preformed portion 542. The secondary gate member 120 preferably includes six deforming collars 550, a deformable energy absorbing member anchor 560, three anchor pins 562, three tether anchor assemblies 570, and a tether anchor plate 580. Each of the tether assemblies 570 includes a tether anchor 572 and fasteners 574, and each of the deforming collars 550 preferably includes four deforming members 552. However, it should be understood that the primary gate member is not limited to having six deforming collars 550 and that the deforming collars 550 are not limited to having four deforming members 552. The primary gate member may have more or fewer than six deforming collars 550, and each deforming collar 550 may have more or fewer than four deforming members 552.

Turning to FIG. 5(*b*), the secondary gate member 120 further includes a tether restraint 520, and a joiner member 590 having an outer surface 592. The tether restraint 520 preferably includes a first restraint 522, a second restraint 524 and a third restraint 526.

In a presently preferred embodiment, the deformable energy absorbing members 440, 540 may be made from galvanized commercial quality round steel tubing having a yield strength of 50,000 PSI and a tensile strength of 55,000 PSI. Preferably, the deformable energy absorbing members 440, 540 have an outer diameter of 2.375 inches, with the deformable energy absorbing members 440 of the primary gate member 110 and the deformable energy absorbing members 540 of the secondary gate member 120 having tubing thicknesses of nine (9) gauge and seven (7) gauge, respectively. It should be understood that the deformable energy absorbing members 440, 540 are not limited thereto, and may utilize different types of steel or materials other than steel, and may utilize tubes having other diameters, shapes, or wall thicknesses.

The deforming collars 450, 550 are preferably sized such that a gap of between 0.0625 and 0.1875 inches exists between the inner surface of the deforming collars 450, 550 and the outer surface of the deformable energy absorbing members 440, 540 in order to prevent binding during operation. Preferably, the deforming collars 450, 550 are made from the same galvanized commercial quality steel as the deformable energy absorbing members 440, 540. The deforming members 452, 552 are preferably made from 0.25 inch thick plate of the same galvanized commercial quality steel as the deformable energy absorbing members 440, 540. However, it should be understood that the deforming collars 452, 552 and the deforming members 452, 552 are not limited thereto, and may be made from different types of steel or materials other than steel, and may have other diameters, shapes, or wall thicknesses.

The vehicle retention tethers 430, 530 are preferably made from braided galvanized steel cable. Preferably, the vehicle retention tethers 430 of the primary gate member 110 are 0.75 inch diameter cable, while the vehicle retention tethers 530 of the secondary gate member 120 are 0.25 inch diameter cable. However, it should be understood that the vehicle retention tethers 430, 530 are not limited thereto, and may be made of any material or thickness of sufficient strength. Preferably, each of the vehicle retention tethers 430, 530 should be of sufficient strength to restrain an impacting vehicle 2 by itself, thereby ensuring that the vehicle 2 is restrained even if one or more of the vehicle retention tethers 430, 530 fails during impact.

Referring again to FIGS. 1 and 2, the secondary barrier assembly 20 is disposed downstream of the primary barrier assembly 10 in a parallel configuration such that the primary and secondary gate members 110 and 120 are substantially parallel to each other in both the retracted and deployed position. Preferably, the secondary barrier assembly 20 is spaced downstream of the primary barrier assembly 10, such that the primary and secondary gate members are preferably eight feet apart in the deployed position. However, it should be understood that the primary and secondary gate members 110, 120 may be spaced more or less than eight feet apart. For example, the gate members 110, 120 may be spaced six feet apart or less, or may be spaced thirty feet apart or more. In configurations where the primary and secondary gate members 110, 120 are spaced farther apart, e.g. 30 feet, the energy absorbing barrier may be configured to trap a vehicle between the primary and secondary gate members 110, 120, and the primary barrier assembly 10 and secondary barrier assembly 20 may be deployed individually (i.e. the primary and secondary barrier assemblies 10, 20 do not have to be deployed simultaneously).

The area between the primary gate receivers 130 and the secondary gate receivers 140 of the foundation 102 constitutes a vehicle pathway through the energy absorbing security gate 100.

The primary and secondary gate recesses 190, 192 in the foundation 102 have substantially the same shape and size as the primary and secondary barrier assemblies 10, 20 in the retracted position and are disposed forward of the primary and secondary gate receivers 130, 140, such that the covers 400, 500 on the rearward side of the primary and secondary gate members 110, 120 are substantially flush with the upper surface of the foundation 102. Because the covers 400, 500 are substantially flush with the foundation 102 when the primary and secondary barrier assemblies 10, 20 are in the retracted position, vehicles can safely travel over the primary and secondary gate recesses 190, 192 in the vehicle pathway. The foundation 102 is designed to rigidly secure the primary and secondary gate receivers and the deployment assemblies 150, 160 and to provide a fixed geometrical relationship therebetween.

The primary and secondary gate receivers 130, 140 are preferably made of steel, and are rigidly anchored to the foundation 102 or the ground. A receiver arm 132, 142 extending away from the primary and secondary gate receivers 130, 140 in an upstream direction is rigidly attached to an upstream surface of each of the primary and secondary gate receivers 130, 140. Each receiver arm includes two slots configured to receive the receiver interface members 122, 132 of the primary and secondary gate members 110, 120 when the primary and secondary barrier assemblies are moved from the retracted position to the deployed position. The receiver arms 132, 142 may also include support braces to increase the strength thereof and to resist the torsional forces applied on the receiver arms 132, 142 by the primary and secondary gate members 110, 120 during impact.

The primary and secondary gate deployment assemblies 150, 160 are disposed adjacent to the outboard side of the base of the primary and secondary gate receivers 130, 140, and may be disposed above the surface of the foundation 102. Alternatively, the deployment assemblies 150, 160 may be disposed below the surface of the foundation 102, and may be disposed within the primary or secondary gate recesses 190, 192. A winch support member 340 abuts, and is preferably attached to the outward facing surface of each of the primary and secondary gate receivers 130, 140.

As shown in FIG. 3, a winch 330 is attached to an upper rearward end of each winch support member 340. A rearward end of a connector member 320 is hingedly connected to the winch support member 340 by a bolt or a shaft, while a forward end of the connector member 320 is attached to the spring reaction plate 322. The spring reaction plate 322 includes two holes through which the upper ends of two guides 324 are inserted. The lower ends of the guides 324 are attached to the spring anchor 326, which is hingedly attached to the lower gate support member 170. A spring 310 is disposed around each of the guides 324 and is compressed between an upper surface of the spring anchor 326 and a lower surface of the spring reaction plate 322. Retention fasteners 328 are threaded onto the upper portions of the guides 324 extending above the spring reaction plate 322 thereby adjustably restraining the degree of compression of the springs 310. A tether 350 is connected at one end to the winch 330, and to the lower support member 170 below the bearings 22 at the opposite end.

The lower gate support member 170 is preferably coupled to four bearings 362 that are rotatably disposed on an axle 360. However, it should be understood that the lower gate support member 170 may be coupled to more or fewer than four bearings 362. The bearings themselves may be any type of bearing known in the art, including for example and without limitation bushings, ball bearings or needle bearings. The axle 360 is fixedly attached to the winch support member 340 and extends through the lower gate support member 170. Each of the lower support members 170 is detachably attached to one of the upper primary or secondary gate support members 172, 182 by welding or fastening the mounting plate 176, which is disposed at an upper end of the lower support members 170, to the mounting plate 174, which is disposed at the lower end of the upper primary or secondary gate support members 172, 182, thereby connecting the lower support members 170 to the primary or secondary gate members 110, 120.

In operation, when the winches 330 are activated, the primary and secondary barrier assemblies 10, 20 are moved into a retracted position. When power is provided to the winches 330, each winch 330 winds up the tether 350 thereby causing the lower support members 170 and the attached primary or secondary gate members 110, 120 to pivot about the axle 360 on the bearings 362 in a counter-clockwise direction. As the lower support members 170 pivot, the spring anchor 326 forces the lower ends of the springs 310 upward, thereby compressing the springs between the spring anchor 326 and the spring reaction plate 322. The springs 310 store energy as they are compressed. The resistance of the springs 310 to compression also ensures that the primary and secondary gate members 110, 120 are lowered in a controlled and gentle manner into the retracted position, thereby minimizing any potential damage to the primary and secondary gate members 110, 120 during the retraction process. The winches 330 continue to wind the tether 350 until the primary and secondary vehicle barriers 10, 20 are in a fully retracted position, wherein the primary and secondary gate members are substantially parallel with the surface of the foundation 102, and the rearward cover 400 of the primary gate member 110 and the rearward cover 500 of the secondary gate member 120 are substantially flush with the surface of the foundation 102. The winch 330 may be stopped by a limit switch or other similar feedback device.

When the winches 330 are activated to move the primary and secondary barrier assemblies 10, 20 into a deployed position, the winches 330 rapidly spool out the tether 350, thereby removing the compressive restraining force on the springs 310. The primary and secondary barrier assemblies 10, 20 may be activated remotely as desired by a button, or switch or the like. The primary and secondary barrier assemblies 10, 20 may also be deployed using sensors that detect the presence of an oncoming vehicle. A microprocessor based system may then determine when to retract or deploy the primary and secondary barrier assemblies 10, 20 based on a predetermined sensory threshold. The primary and secondary barrier assemblies may also include a manual deployment or retraction mechanism to control the deployment of the gate in the event of a power outage or the like. The springs 310 then force the lower support members 170 to rotate in a clockwise direction, which in turn forces the primary and secondary gate members 110, 120 to rotate in a clockwise direction until the receiver interface members 122 contact the rear surface of the slots in the receiver arms 132, 142, and the covers 400, 500 of the primary gate member 110 and the secondary gate member 120 are substantially perpendicular to the surface of the foundation 102. Preferably, the deployment assemblies 330 are capable of moving the primary and secondary vehicle barriers 10, 20 from the retracted position to the deployed position in a matter of seconds. Preferably, the gates are configured to be deployed in less than two seconds. However, the gate may be configured to deploy in less than a second, or between two and five seconds. Note that the primary and secondary barrier assemblies 10, 20 may be moved from the retracted position to the deployed position by means other than a winch/spring combination. For example, the barrier assemblies 10, 20 may be deployed or retracted using a linear actuator or the like. The linear actuator may be motor or hydraulically driven.

Preferably, both the primary and secondary vehicle barriers 10, 20 are retracted or deployed simultaneously. However, it should be understood that either the primary or the secondary vehicle barrier may be deployed or retracted separately and/or successively. Further, the primary and secondary vehicle barriers 10, 20 preferably include a locking mechanism that secures the primary and secondary gate members to the primary and secondary gate receivers 130, 140 in the deployed position. It should also be understood that the primary and secondary gate members 110, 120 may be moved from the retracted position to the deployed position by means other than rotation about a fixed axis and may include deployment units 150, 160 that use means other than a winch/spring combination to move the gate members 110, 120. For example, the primary and secondary gate member 110, 120 may be lowered or raised from a position in which the gate will not impede a vehicle 2 traveling through the vehicle path, to a position in which the gate will impede a vehicle 2 traveling through the vehicle path. The primary and secondary gate members 110, 120 may be moved from the retracted position to the deployed position by a pneumatic or hydraulic piston, or by an electric motor or the like. In this alternative embodiment, the deployment units 150, 160 are modified to raise and lower the primary and secondary vehicle barriers 10, 20 in a substantially vertical plane, without rotation about an axis. The recesses 190, 192 may include a deep slot having a height of at least the height of the primary and secondary vehicle barriers 10, 20. The deep slots are configured to receive the primary and secondary vehicle barriers respectively. In another embodiment, the primary and secondary gate members 110, 120 may rotate about a vertical axis from the retracted position to the deployed position.

As shown in FIGS. 4-4(*b*), two receiver interface members 122 are vertically spaced apart such that the upper receiver interface members 122 are disposed adjacent the upper ends of the upper primary gate support members 172 and the deformable energy absorbing member anchors 460, and the lower receiver interface members 122 are disposed adjacent the mounting plate 174 and the lower end of the deformable energy absorbing member anchors 460. The outboard end of each of the four receiver interface members 122 are rigidly attached to the upper primary gate support members 172, while the inboard end of each of the four receiver interface members 122 are rigidly attached to the deformable energy absorbing member anchors 460, preferably by welding. Of course it should be understood that the receiver interface members 122 may also be rigidly attached using fasteners such as bolts, rivets, cotter pins, or the like.

The outboard ends of the upper and lower pairs of deformable energy absorbing members 440 are fixedly attached to the deformable energy absorbing member anchors 460 and extend laterally inward through the tether anchor plates 480 toward the center of the primary gate member 110. The deformable energy absorbing members 440 are preferably attached to the deformable energy absorbing member anchors 460 by pinning, however, it should be understood that the deformable energy absorbing members 440 may be attached by welding or other means known in the art. Preferably, the upper and lower pairs of deformable energy absorbing members 440 extend from the deformable energy absorbing anchors 460 to the center of the primary gate member 110 such that the inboard ends of the two upper deformable energy absorbing members 440 are disposed proximate each other, and the inboard ends of the two lower deformable energy absorbing members 440 are disposed proximate each other.

The upper pair of deformable energy absorbing members 440 is detachably connected by a joiner member 490 that is disposed within the deformable energy absorbing members 440 such that the outer surface 492 of the joiner member abuts the inner surface 441 of the deformable energy absorbing members 440. The joiner member is detachably fixed to the deformable energy absorbing members 440 by a frangible connector, such as for example and without limitation, a shear pin, a bolt, or welding. However, it should be understood that the joiner member may have an inner diameter that is larger than the outer diameter of the deformable energy absorbing members 440, and the inboard ends of the deformable energy absorbing members 440 may be inserted into, and detachably attached to the joiner member 490. In another embodiment, the inboard ends of the deformable energy absorbing members 440 may be frangibly attached to each other, for example by welding.

In operation, the joiner member 490 allows each of the pairs of deformable energy absorbing members 440 to act as a single member extending the entire width of the primary gate member 110 and distribute the loads experienced during normal operation among the four deformable energy absorbing members 440. During an impact, the attachment fasteners or welded joint connecting the joiner member 490 to the deformable energy absorbing members 440 form a frangible connection that is configured to fail in a controlled manner and thereby detach from one or both of the deformable energy absorbing members 440.

Similarly, the lower pair of deformable energy absorbing members 440 is detachably connected by a joiner member 490 that is disposed within the deformable energy absorbing members 440 such that the outer surface 492 of the joiner member abuts the inner surface 441 of the deformable energy absorbing members 440. The joiner member is detachably fixed to the deformable energy absorbing members 440 by a frangible connector, such as for example and without limitation, a shear pin, a bolt, or welding. In an alternative embodiment the upper and lower pairs of deformable energy absorbing members 440 are replaced with a single pair of deformable energy absorbing members 440 spaced vertically apart. In this alternative embodiment a region of the energy absorbing members 440, preferably the central portion, is weakened by scoring or the like such that the upper and lower deformable energy absorbing members 440 fracture at the weakened region, thereby breaking the single deformable energy absorbing member into two separate deformable energy absorbing members as the primary gate member 110 deforms from a pre-impact configuration to an impact configuration.

Referring to the preferred embodiment shown in FIGS. 4-4(*b*), the tether anchor plates 480 are disposed laterally inboard of, and are substantially parallel to the deformable energy absorbing member anchors 460. Three vehicle retention tethers 430 are spaced vertically apart at predetermined intervals and extend laterally between the two tether anchor plates 480. The vehicle retention tethers 439 are adjustably secured to the tether anchor plates 480 by the tether anchors 472 and fasteners 474 disposed inboard and outboard of the tether anchor plates 480. The tethers are preferably configured as steel cables. The upper vehicle retention tether 430 is preferably disposed above the upper deformable energy absorbing member 440, while the central vehicle retention tether 430 is preferably disposed between the upper and lower pair of deformable energy absorbing members 440, and the lower vehicle retention tether 430 is preferably disposed below the lower pair of deformable energy absorbing members 440. However, it should be understood that the configuration and position of the vehicle retention tethers 430 relative to the deformable energy absorbing members 440 is not limited thereto. Furthermore, the primary gate member 110 may include more or less than three vehicle retention tethers 430 or more or less than four deformable energy absorbing members 440.

Two deforming collars 450 are fixedly attached to the inboard surface of the tether anchor plates 480 and disposed around the deformable energy absorbing members 440. Each deforming collar 450 includes four deforming members 452 that are preferably inserted through slots cut into the deforming collars 450, and are thereafter fixedly secured thereto. The deforming members 452 are configured to be inserted through the slots such that the deforming members 450 at least minimally engage the deformable energy absorbing members 440 during impact, as disclosed in U.S. Pat. No. 7,396,184, U.S. patent application Ser. Nos. 11/223,471 and 12/349,056 and U.S. Provisional Patent Application No. 61/019,488, all of which are assigned to Energy Absorption Systems, Inc., the assignee of this invention, and all of which are hereby incorporated by reference herein in their entirety.

The degree of engagement between the deforming members 452 may be adjusted by increasing or decreasing the depth of insertion, or the amount of protrusion into the interior space of the deforming collar 450. Of course, it should be understood that the deforming members 452 may also be rigidly attached to the inside wall of the deforming collar 450, instead of inserted through a slot.

Each deformable energy absorbing member 440 includes a tapered preformed portion 442 that may be shaped to accommodate and interface with the deforming members 452, thereby defining a first energy absorbing region. The inboard edge of the preformed portion 442 is disposed inboard of the deforming collars 450, and extends laterally in an outboard direction such that the preformed portion 442 extends at least partially into the deforming collars 450.

A tether restraint 420 may be disposed in a central portion of the primary gate member 110. The tether restraint 420 consists of at least three tether restraints, or loops disposed laterally adjacent one another. The first restraint 422 encircles the upper and central vehicle retention tethers 430 and the upper deformable energy absorbing member 440. The second restraint encircles the central and lower vehicle retention tethers 430 and the lower deformable energy absorbing member 440, while the third restraint encircles all three vehicle restraint tethers 430 and both the upper and lower deformable energy absorbing members 440. However, it should be understood that the tether restraint 420 may be disposed in a non-central portion of the primary gate member 110, or a plurality of tether restraints 420 may be employed and disposed at various locations along the primary gate member 110.

At least two spacing support members 410 are disposed between the tether anchor plates 480 such that the upper, central, and lower vehicle retention tethers 430 are inserted into and extend laterally through the upper, central, and lower tether notches 412 respectively, and the upper deformable energy absorbing members 440 are inserted into and extend laterally through the upper and lower receiver apertures 414 respectively. The tether notches 412 and the receiver apertures 414 are spaced at set vertical distances from each other that correspond to the pre-impact configuration and vertical spacing of the vehicle retention tethers 430 and the deformable energy absorbing members 440. Therefore, because the vehicle retention tethers 430 and deformable energy absorbing members 440 extend through the tether notches 412 and the receiver apertures 414 respectively, the spacing support members 410 operate to restrain the amount of relative vertical movement between the vehicle retention tethers 430 and the deformable energy absorbing members 440 during impact.

In addition to restraining relative movement between the vehicle retention tethers 430 and the deformable energy absorbing members 440 during impact, the spacing support members 410 also operate to support the covers 400 from collapsing or permanently deforming under the weight of a vehicle 2 traveling over the primary vehicle barrier 10 in its retracted position. In this configuration the covers 400 operate to transfer the load from the wheels of a vehicle 2 to the spacing support members 410, which then transfer the load to the ground or other components of the foundation 102.

The covers 400 may be attached to only the forward side or the rearward side of the primary gate member 110, both the forward and the rearward sides of the primary gate member 110, or alternatively, the cover 400 may be eliminated entirely from the primary gate member 110. In the case where the primary gate member 110 has a single cover, the cover is preferably attached to the rearward side of the gate to protect the gate member 110 from being damaged by vehicles traveling over the energy absorbing vehicle barrier 100 when the primary vehicle barrier 10 is in the retracted position. The cover 400 is preferably attached to the tether anchor plates 480, the deformable energy absorbing member anchors 460, and the spacing support members 410 by fasteners, such as bolts, rivets, or the like. Further, the cover 400 is preferably attached to the tether anchor plates 480 by frangible fasteners, such as a shear pin, or other fasteners such as a bolt or rivet having a sufficiently low shear strength to shear off and thereby allow the tether anchors 480 to translate laterally in a substantially inward direction when the primary vehicle barrier 10 is impacted by a vehicle 2.

Referring to FIGS. 5-5(*b*), the components of the secondary gate member 120 operate in the same manner, and are arranged in substantially the same configuration as the components of the primary gate member 110. However, the secondary gate member 120 includes an additional pair of deformable energy absorbing members 540 and corresponding deforming collars 550 and deforming members 552.

In operation, when an unauthorized or unwanted vehicle 2 enters into the vehicle pathway, the primary and secondary vehicle barriers 10, 20 are moved from the retracted position to the deployed position. The primary and secondary vehicle barriers 10, 20 may be manually deployed, or may be automatically deployed using a sensor system.

Figure 6:
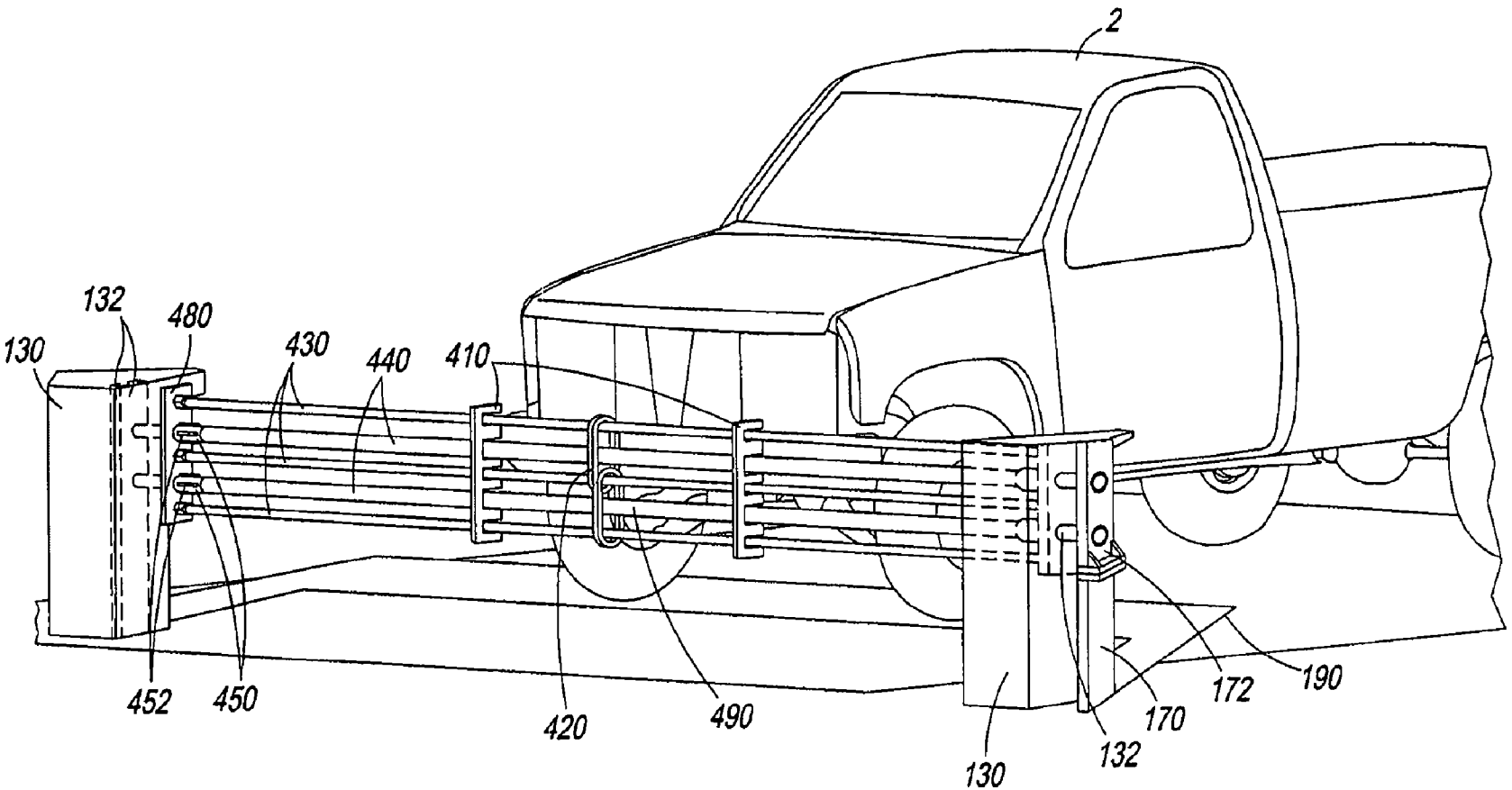
FIG. 6 is a perspective view of the primary gate assembly of the energy absorbing vehicle barrier of FIG. 1 in a deployed, pre-impact position.
Figure 7:
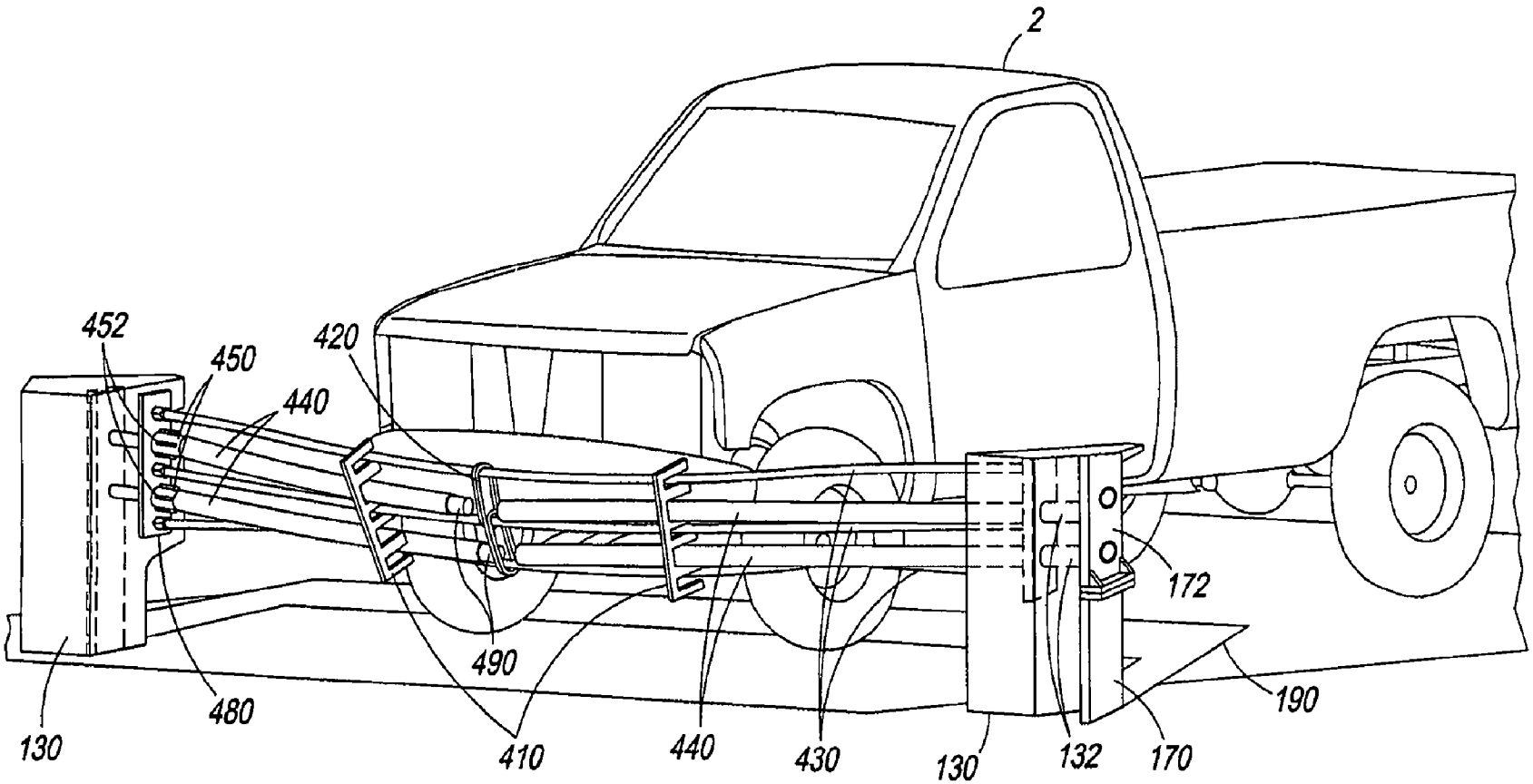
FIG. 7 is a perspective view of the primary gate assembly of FIG. 6 in an intermediate impact position.
Figure 8:
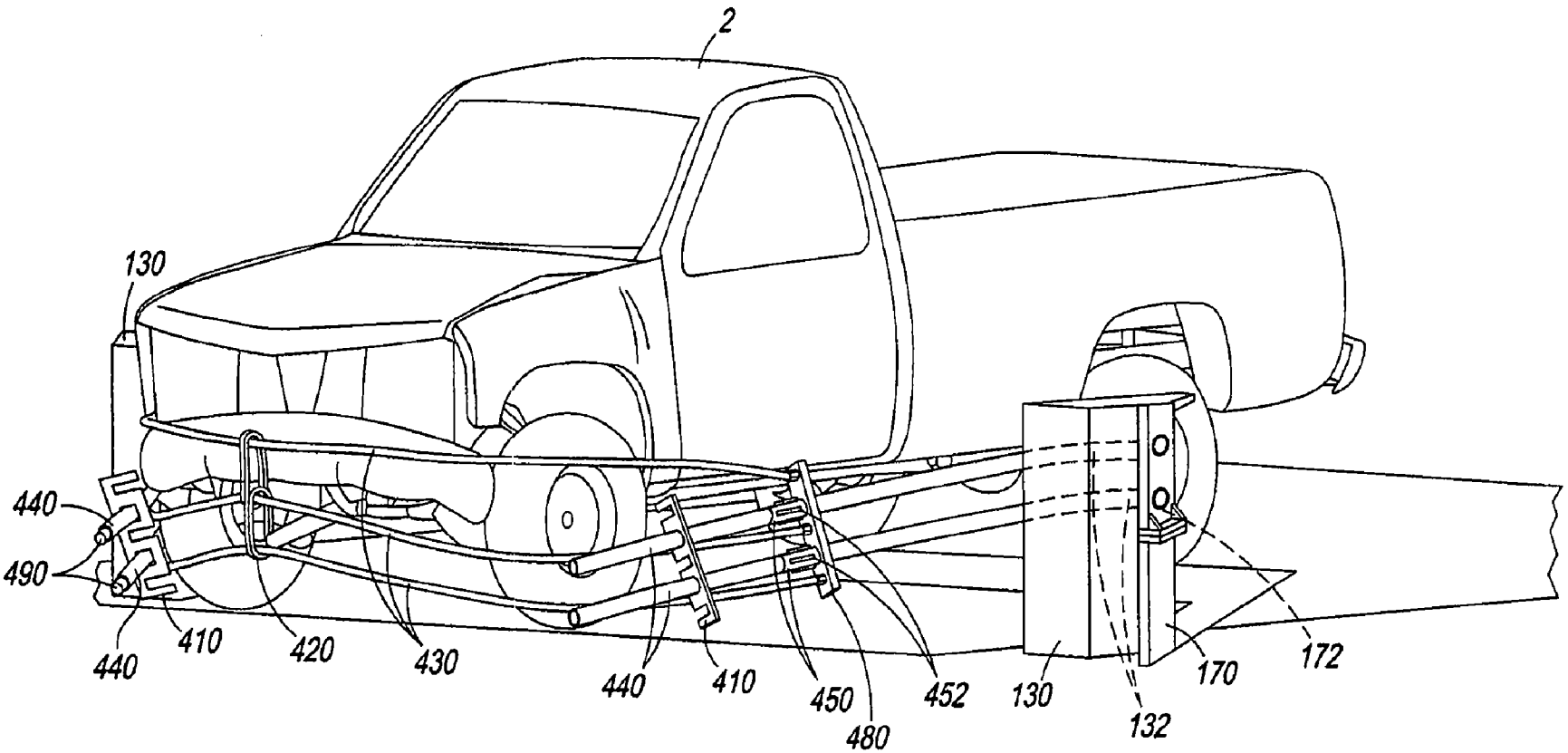
FIG. 8 is a perspective view of the primary gate assembly of FIG. 6 in an impact position.

FIGS. 6-8, illustrate a sequential view of a vehicle impacting the primary vehicle barrier 10, in which the covers 400 have been removed to better illustrate the operation of the components of the primary gate member 110. As shown in FIG. 6, the vehicle 2 may travel toward the primary vehicle barrier 10 in its pre-impact position. Typically, because the primary vehicle barrier 10 is disposed upstream of the secondary vehicle barrier 20, an impacting vehicle 2 will contact the primary vehicle barrier first. Furthermore, because the primary vehicle barrier 10 is the first and therefore most likely barrier to be impacted by a vehicle, the primary vehicle barrier is designed to be at a height that is appropriate to engage and capture typical passenger vehicles, from small 820 kilogram cars to 2000 kilogram pickup trucks/SUVs. The gate is also designed to provide appropriate deceleration forces to these vehicles, so that they are safely stopped, while still being prevented from entering the secure facility. One standard to determine whether small 820 kilogram cars and 2000 kilogram pickup trucks/SUVs can be safely stopped is defined by The National Cooperative Highway Research Program Report 350 (NCHRP 350), which describes crash tests that verify that a device is safe to place on the National Highway system. The energy absorbing vehicle barrier 100 of the present invention is designed to safely decelerate and stop vehicles conforming to this standard (NCHRP 350, TL-2) that impact the primary vehicle barrier 10 traveling at a rate of 70 kph (kilometers per hour). In a preferred embodiment, the bottom of the primary gate member 110 is disposed eleven inches above the ground, and the bottom cable 430 is disposed two inches above the bottom of the primary gate member 110, or 13 inches above the ground, while the top of the primary gate member 110 is disposed 30 inches above the ground and top cable 430 is disposed two inches below the top of the primary gate member 110, or 28 inches above the ground. In one embodiment, the bottom of the secondary gate member 120 is disposed 20.75 inches above the ground, and the bottom cable is disposed two inches above the bottom of the secondary gate member 120, or 22.75 inches from the ground, while the top of the secondary gate member 120 is disposed 34.88 inches above the ground, and the top cable is disposed two inches below the top of the secondary gate member 120, or 32.88 inches from the ground. However, it should be understood that both the primary and secondary gate members 110, 120 may be higher or lower than their preferred configuration. Note that the primary gate member 110 is preferably not raised above a level at which the primary gate member 110 is likely to contact the windshield of a small 820 kilogram car in impact.

In contrast, the secondary vehicle barrier 20 has a height that is vertically greater than the position of the primary vehicle barrier 10, in order to engage and capture larger vehicles, such as a typical 6,800 kg medium-duty truck. These larger vehicles are stopped with higher deceleration forces to ensure that the vehicles are stopped within a short distance. Although the deceleration forces exerted by the secondary vehicle barrier 20 are higher than those exerted by the primary vehicle barrier 10, the deceleration forces are maintained at a level that still ensures the safety of errant drivers. Moreover, the energy absorbing vehicle barrier 100 of the present invention is further designed to conform to the Department of State (DOS) Standard SD-STD-02.01, as well as the ASTM Standard F2656-07, which requires a barrier to stop a 6,800 kg medium-duty truck with less than 1 meter of penetration (K-12 rating, with a P1 penetration rating).

As shown in the example of FIG. 7, when the vehicle impacts the primary vehicle barrier 10, the cover 400 (not shown in FIG. 7) and the vehicle retention tethers 430 engage the front end of the vehicle. Once the vehicle retention tethers 430 have captured the vehicle 2, the vehicle retention tethers become taut, thereby applying a tensile force on the tether anchor plates 480 in an inboard and rearward direction. Preferably, this force causes the shearable fasteners 404 connecting the cover 400 to the tether anchor plates 480 to shear off, thereby freeing the tether anchor plates 480 to move more freely in an inboard direction.

As the tether anchor plates 480 are drawn inward by the vehicle retention tethers 430, the deforming collars 450 and the deforming members 452 are forced to slide along the deformable energy absorbing members 440. Because the deformable energy absorbing members are rigidly attached to the primary gate receivers 130 through the deformable energy absorbing anchors 460, the deformable energy absorbing members are unable to move inward and therefore remain stationary relative to the deforming collars 450 and deforming members 452.

Initially, the deforming collars 450 move along the preshaped portion 442. The preshaped portion 442 may taper from the maximum outer diameter of the deformable energy absorbing members 440 to a diameter that is smaller than an inner diameter defined by the innermost edge of the deforming members 452. The preshaped portion 442 may vary in length in order to adjust the energy absorption for the particular energy absorbing vehicle barrier.

The preshaped portion 442 may also be configured such that it substantially mates with the configuration of the deforming members 452 within the deforming collars 450. In this configuration, the preshaped portion 452 will act primarily as a guide for the deforming member 452, and is not configured to deform and absorb energy during impact. Once the deforming collars 450 and the deforming members 452 travel past the pre-shaped portion, the deforming members 452 begin to engage the deformable energy absorbing members 450. It should be understood that the deformable energy absorbing members 440 are not limited to round tubes and may be tubes or solid bars having any cross-sectional shape, including for example and without limitation octagonal, hexagonal, quadrilateral, and oval.

As the deforming members 452 engage and deform the deformable energy absorbing members 440 energy is absorbed. Each deforming collar 450 is preferably configured to create a resistance force of between 11,000 and 15,000 pounds. The amount of energy absorbed by the primary gate member 110 is dependent upon a number of variables, including for example the degree the deforming members 452 extend into the annular space of the deforming collars 450, the material the deformable energy absorbing members 440 are made from, the number of deforming members 452 disposed on the deforming collars 450, and the surface finish or coating on the deformable energy absorbing members 440. Therefore, any combination of materials, degree of interference between the deforming members 452 and the deformable energy absorbing members 440 or the surface finish or coating thereon may be used to achieve the above recited preferred resistance force. Furthermore, the amount of energy absorbed by the primary gate member 110 may be tuned to absorb more or less energy than the preferred resistance force by varying any single, or any combination of, the above described parameters.

Shortly after the initial impact, the joiner members 490 become detached from one or both of the connected deformable energy absorbing members 440. As the impact event progresses, the deformable energy absorbing members begin to deflect in a downstream direction and the inboard ends of the upper and lower pairs of deformable energy absorbing members 440 begin to separate. As the deformable energy absorbing members 440 continue to separate, the impacting vehicle 2 will travel between the deformable energy absorbing members 440 until the deforming collars 450 contact the stops 443.

During the impact event, the spacing support members 410 and the tether restraint 420 substantially maintain the spacing between the vehicle retention tethers 430 and the deformable energy absorbing members 440 and help prevent the potential overlapping or entanglement of the vehicle retention tethers 430 which could compromise the ability of the primary gate member 110 to restrain the vehicle 2 during impact. Furthermore, the spacing support members 410 and the tether restraint 420 prevent the vehicle 2 from pushing the vehicle restraint tethers 430 apart from each other, which helps to ensure that the vehicle retention tethers 430 may adequately capture the vehicle 2.

In the event the vehicle 2 impacts the primary vehicle barrier 10 with a force exceeding the maximum force the primary barrier 10 is designed to absorb, e.g. an 820 kg or 2000 kg vehicle traveling at a speed greater the design limit, or a larger vehicle, such as a 6800 kg vehicle impacting the barrier, the vehicle 2 will contact the secondary vehicle barrier 20. As shown in FIGS. 5-5(*b*) and described above, the secondary vehicle barrier 20 is designed to absorb more energy than the primary vehicle barrier 10 in the same manner as the primary vehicle barrier 10. In the preferred embodiment, this increased energy absorption is accomplished through the inclusion of an additional pair of deformable energy absorbing members 540 and corresponding deforming collars 550 and deforming members 552.

Preferably, each deforming collar 550 creates a resistance force of between 17,000 and 21,000 pounds. As with the primary vehicle barrier 110, it should be understood that the total amount of energy that can be absorbed by the secondary vehicle barrier 20 is dependent upon many variables, for example, the degree the deforming members 552 extend into the annular space of the deforming collars 550, the material the deformable energy absorbing members 540 are made from, the number of deforming members 552 disposed on the deforming collars 550, and the surface finish or coating on the deformable energy absorbing members 540. Therefore, any combination of materials, degree of interference between the deforming members 552 and the deformable energy absorbing members 540 or the surface finish or coating thereon may be used to achieve the above recited preferred resistance force. Furthermore, the amount of energy absorbed by the secondary gate member 120 may be adjusted by varying any single, or any combination of, the above described parameters, and may be configured to absorb more or less force than the preferred resistance force.

It should be understood that the secondary gate member 120 may utilize more or less than three pairs of deformable energy absorbing members 540. It should also be understood that the number of vehicle retention tethers utilized in the primary and secondary gate members 110, 120 may vary according to a particular application or the needs of a particular situation. Some applications may only utilize one vehicle retention tether, while others may use two, three, or more vehicle retention tethers.

In an alternative embodiment, the secondary gate member 120 may have the same number of deformable energy absorbing members 540 as the primary gate member 110, e.g. two pairs of deformable energy absorbing members 540, however the deformable energy absorbing members 540 may be made from made of a heavier gauge material, or the material or configuration of components may be otherwise altered to increase its energy absorption characteristics, thereby providing increased energy absorption capabilities over the primary gate member 110.

Figure 9:
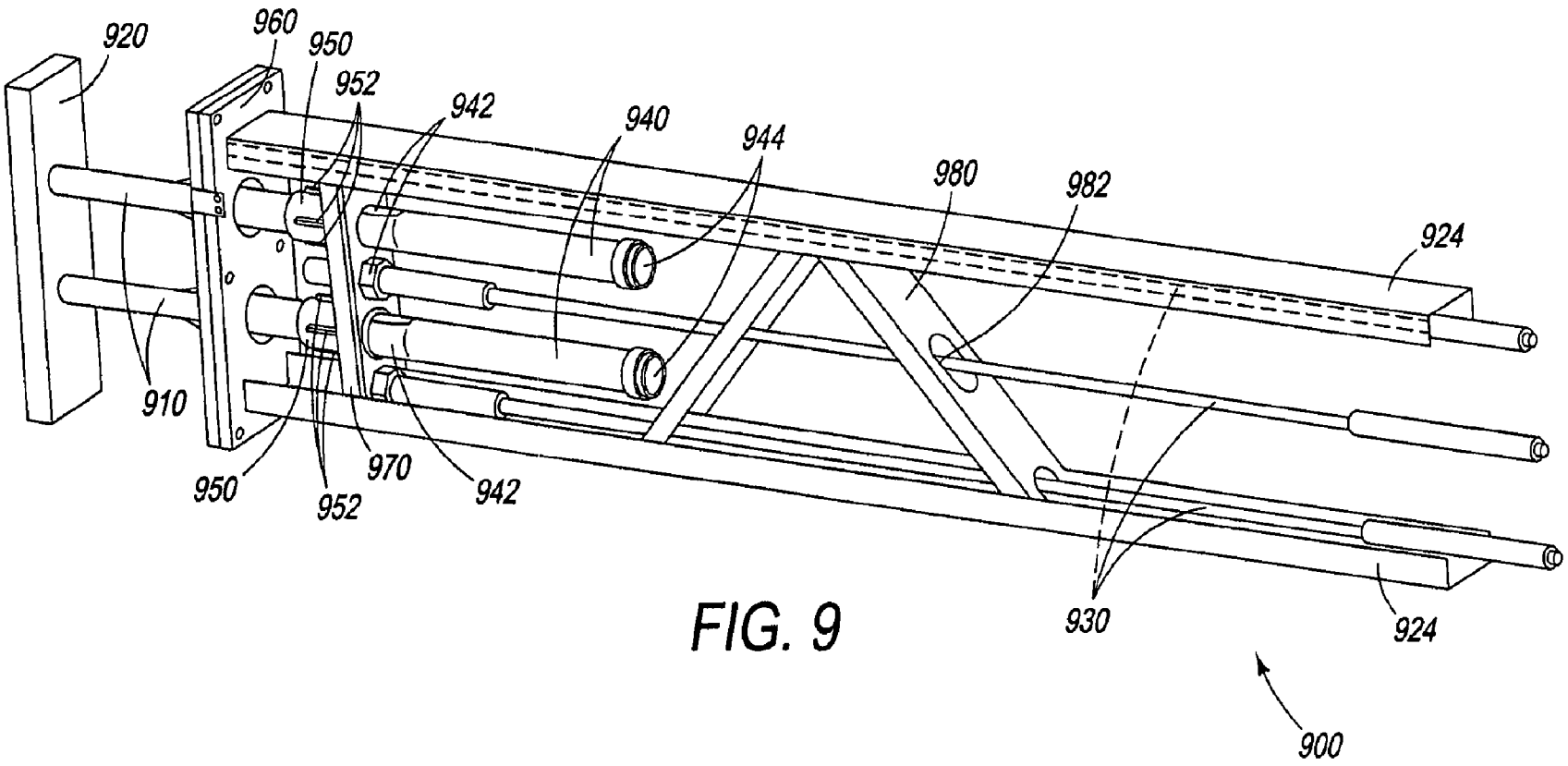
FIG. 9 is a perspective view of another embodiment of a gate member.

FIG. 9 illustrates an alternative embodiment of the primary or secondary gate members 110, 120. The gate member 900 includes an upper support member 920, a deformable energy absorbing member anchor plate 960, a tether anchor plate 970, tether supports 980, two support channels 924, two receiver interface members 920, three vehicle retention tethers 930, and two deformable energy absorbing members 940 having a pre-shaped portion 942 and stops 944. The gate member 900 further includes deforming collars 950, each deforming collar 950 having four deforming members 952.

The outboard end of each of the deformable energy absorbing members 940 is fixedly attached to the deformable energy absorbing member anchor plate 960. The deformable energy absorbing members 940 are disposed within the deforming collars 950 and extend in an inboard direction. The pre-shaped portion 942 of the deformable energy absorbing members 940 are disposed inboard of the deforming collars 950 and are substantially the same in design and operation to those described above with regard to FIG. 4(*a*). A stop 944 is attached to the inboard ends of the deformable energy absorbing members 940. The stop 940 operates to limit the travel of the tether anchor plate 980 and the attached deforming collars 950 when the gate member 900 is deformed from a pre-impact configuration to an impact configuration. In this embodiment, the deformable energy absorbing members 940 do not extend all the way to the center of the gate member 900, but rather provide a shorter energy absorption travel path or stroke. Once the inboard surface of the tether anchor plate 980 contacts the stops 944, the deformable energy absorbing members 940 will no longer absorb energy and the gate member 900 will act more like a rigid barrier.

The deformable energy absorbing member anchor plate 960 is fixedly attached to the upper support member 920 through the receiver interface members 910. The tether anchor plate 970 is contained within the upper and lower support channels 924 and includes deforming collars 950 attached to its outboard surface. Each of the deforming collars 950 includes deforming members 952 identical to those described above with regard to FIG. 4(*a*). As the gate member 900 is impacted, the vehicle retention tethers, which are supported and restrained by the tether supports 980, pull the tether anchor plate 970 and the attached deforming collars 950 along the deformable energy absorbing members 952. The tether anchor plate 970 is guided by the guide channels 924 as it travels in an inboard direction. The guide channels 924 also operate as support spacers giving the gate member 900 and an attached cover (not shown) the necessary strength to adequately support the weight of a vehicle 2 driving over the gate member 900 in a retracted position.

FIG. 10 illustrates an alternative embodiment of an energy absorbing assembly 1000 to be used in a gate member. The energy absorbing assembly 1000 includes a pair of deforming members 1040, a tether 1020 having an eyelet 1010, a pair of anchor plates 1030, and a connecting member 1050 having four deforming members 1060 at each end.

In this embodiment, the tether 1020 is disposed within and extends through the center of the deformable energy absorbing members 1040. The tether 1020 is preferably made from flat nylon straps, but may also be made of steel cable or other suitable flexible structural member. The tether 1020 preferably has integral eyelet 1010 disposed at the extreme ends of the tether 1020 that may be attached to anchor plates 1030, which are in turn attached to a gate member supporting structure. Note that the anchor plates 1030 are analogous to the anchor plate 920 of FIG. 9 in function and operation. The connecting member 1050 is disposed in a central portion of the gate member and the inboard portions of the deformable energy absorbing members 1040 extend into the connecting member 1050. A deforming member 1060 is inserted through a slot disposed on each face of the square tube proximate to each of the outboard ends of the connecting member 1050 and configured to engage and deform the corresponding deformable energy absorbing member 1040.

In operation, when a vehicle impacts the gate member, initially, the centrally located connecting member 1050 is accelerated in the impact direction. Because the deformable energy absorbing members 1040 are rigidly attached to a gate member supporting structure, such as for example, the gate receivers 130, 140 of FIG. 1, the deformable energy absorbing members 1040 are unable to move in a laterally inward direction. As the connecting member 1050 begins to move relative to the deformable energy absorbing members 1040, the deforming members 1050 engage and deform the deformable energy absorbing members 1040, thereby absorbing energy. This energy absorption process continues until the tether 1020 is pulled taut, at which time the connecting member 1050 will be restrained from further deflection in the impact direction, and the gate member will act more like a rigid barrier.

Figure 11:
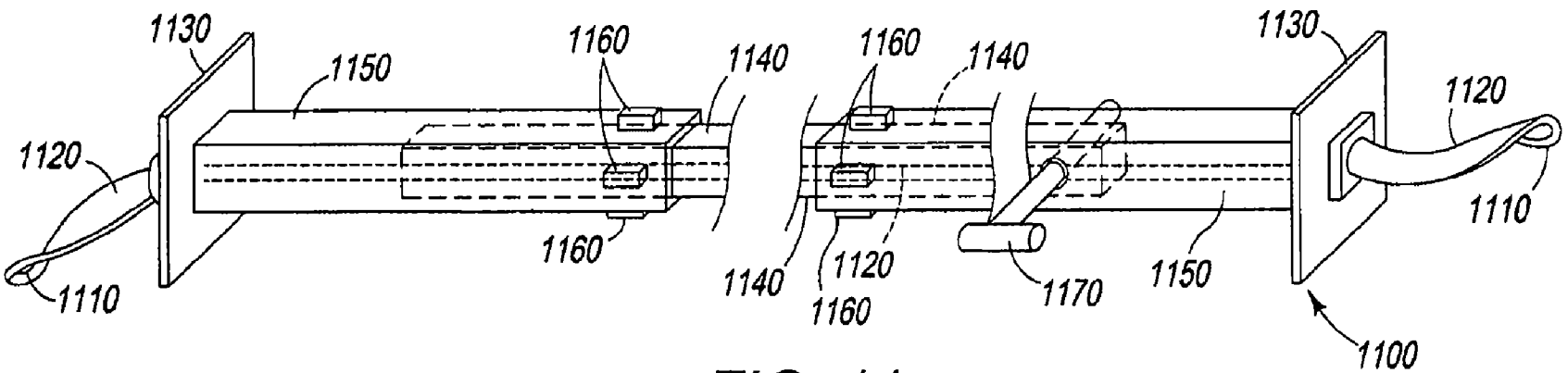
FIG. 11 is a perspective view of another embodiment of an energy absorption assembly.

FIG. 11 illustrates another alternative embodiment of an energy absorbing assembly 1100 to be used in a gate member that is similar in structure to the energy absorbing assembly 1000. The energy absorbing assembly 1100 includes a single deforming member 1140, a pair of anchor plates 1130, a tether 1120 having an eyelet 1110, and a pair of receiver members 1150, each receiver member 1150 having four deforming members 1160. Note that the anchor plates 1130 are analogous to the anchor plate 920 of FIG. 9 in function and operation.

In this embodiment, the tether 1120 is disposed within and extends through the center of the deformable energy absorbing member 1140 and the receiver members 1150. As with energy absorbing assembly 1000, the tether 1120 is preferably made from flat nylon straps, but may also be made of steel cable or other suitable flexible structural member. The tether 1120 preferably has integral eyelet 1110 disposed at the extreme ends of the tether 1120 that may be attached to anchor plates 1130, which are in turn attached to a gate member supporting structure. The outboard end of the receiver members 1150 are attached to the anchor plates 1130 and extend inward toward the center of the gate member. A deforming member 1160 is inserted through a slot disposed on each face of the square tube proximate to each of the inboard ends of the receiver members 1150 and is configured to engage and deform the deformable energy absorbing member 1140. The single deforming member 1140 extends into the center of both of the receiver members 1150 such that the outboard ends of the deformable energy absorbing member 1140 are disposed outboard of the inboard ends of the receiving members 1150.

In operation, when a vehicle impacts the gate member, initially, the deformable energy absorbing member 1140 is accelerated in the impact direction. Because the receiving members 1150 are rigidly attached to a gate member supporting structure, such as for example, the gate receivers 130, 140 of FIG. 1, the receiving members 1150 are unable to move in a laterally inward direction. Thus, as the deformable energy absorbing member 1140 begins to move relative to the receiver members 1150, the deforming members 1160 engage and deform the portion of the deformable energy absorbing members 1140 disposed outboard of the inboard ends of the deforming members 1150, thereby absorbing energy. This energy absorption process continues until the tether 1120 is pulled taut, at which time the deformable energy absorbing member 1140 will be restrained from further deflection in the impact direction, and the gate member will act more like a rigid barrier. Additionally, the energy absorbing assembly 1100 may also include a locking pin 1170 that may be inserted through apertures disposed in the receiver member 1150 and the deformable energy absorbing member 1140, as shown in FIG. 11, thereby mechanically connecting the two tubes together. In this way, the gate member cannot easily expand and the amount of displacement of the gate member is limited, and therefore the potential penetration of an impacting vehicle 2 is limited. Although this locking feature is not shown in FIGS. 1-10, it should be understood that a similar locking feature may be incorporated into any of the embodiments of the present invention. Furthermore, the embodiments of FIGS. 10 and 11 are not limited to the square tubes shown, and either the outer, or the inner, or both tubes could be of any other appropriate shape, for instance round, triangular, rectangular, six-sided, eight-sided, etc.

Figure 12:
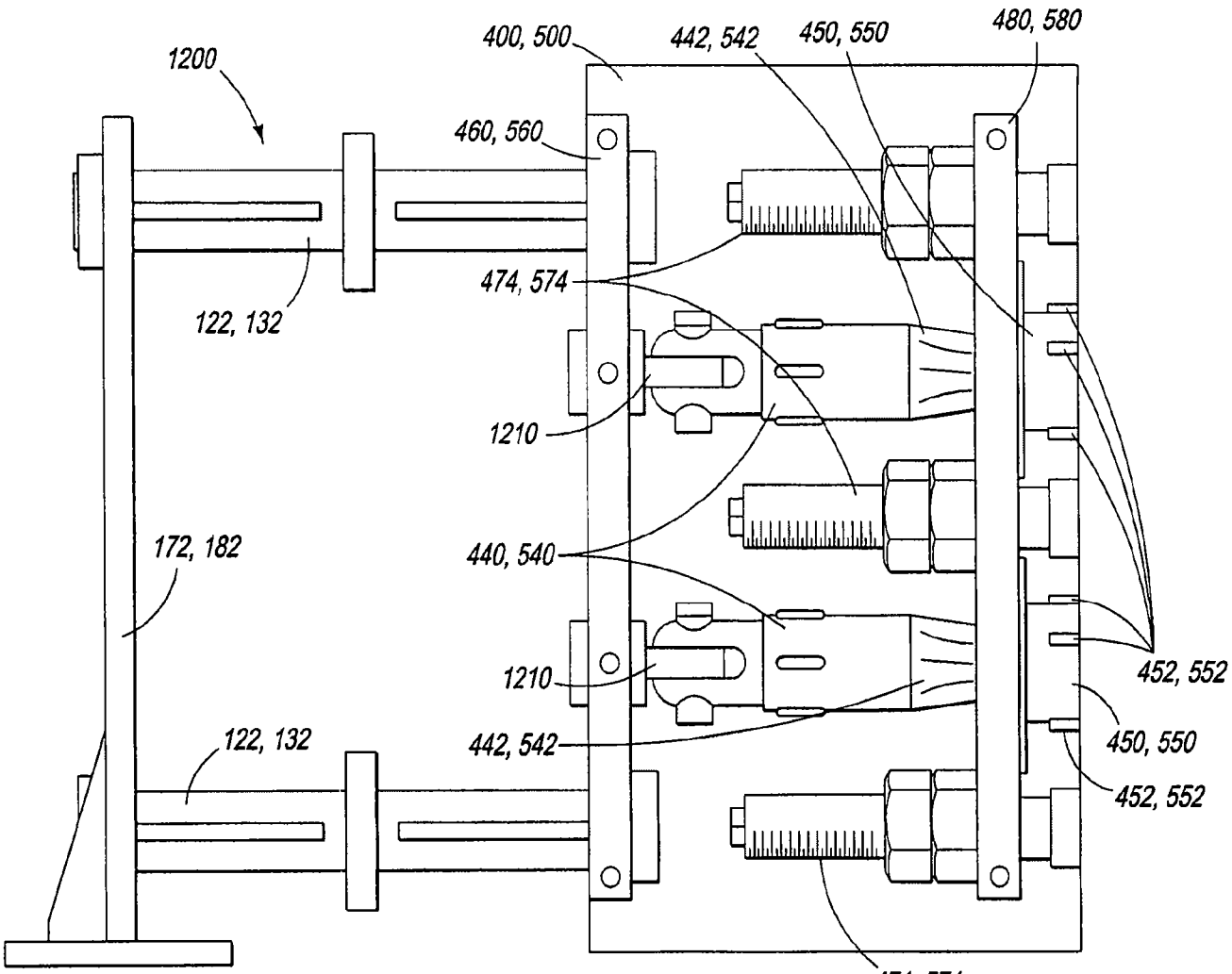
FIG. 12 is a front view of an alternative gate member assembly.

FIG. 12 illustrates an alternative embodiment of the primary and secondary gate members 110, 120. As shown in FIG. 12, the components of a gate member 1200 are arranged in substantially the same configuration as the components of the primary gate member 110 and the secondary gate member 120. However, the outboard ends of the deformable energy absorbing members 440, 540 of the gate member 1200 are attached to the deformable energy absorbing member anchor 460, 560 by a hinge member 1210. The deformable energy absorbing members 440, 540 may be attached to the hinge member 1210 by welding, or fasteners such as rivets, bolts, or the like.

In operation, the gate member 1200 functions in essentially the same manner as the primary and secondary gate members 110, 120. However, unlike the primary and secondary gate members 110, 120, when a vehicle 2 impacts and the gate member 1200 begins to deform in the impact direction 1, the deformable energy absorbing members 440, 540 rotate or pivot about hinge member 1210 as the inboard ends are forced rearward by the vehicle, and the deformable energy absorbing members are deformed by the deforming members 442, 542 of the deforming collars 450, 550. In this embodiment, the hinge member 1210 helps to reduce the forces at the outboard end of the deformable energy absorbing members 440, 540 by allowing the deformable energy absorbing members 440, 540 to hinge rearwardly with the impacting vehicle, thereby minimizing the bending moment applied to the deformable energy absorbing members 440, 540. Because the bending moment is minimized, the deformable energy absorbing members 440, 540 are subjected to primarily only the tensile loads applied by the deforming members 442, 542 as they deform the deformable energy absorbing members 440, 540 in an inboard direction.

Figure 13:
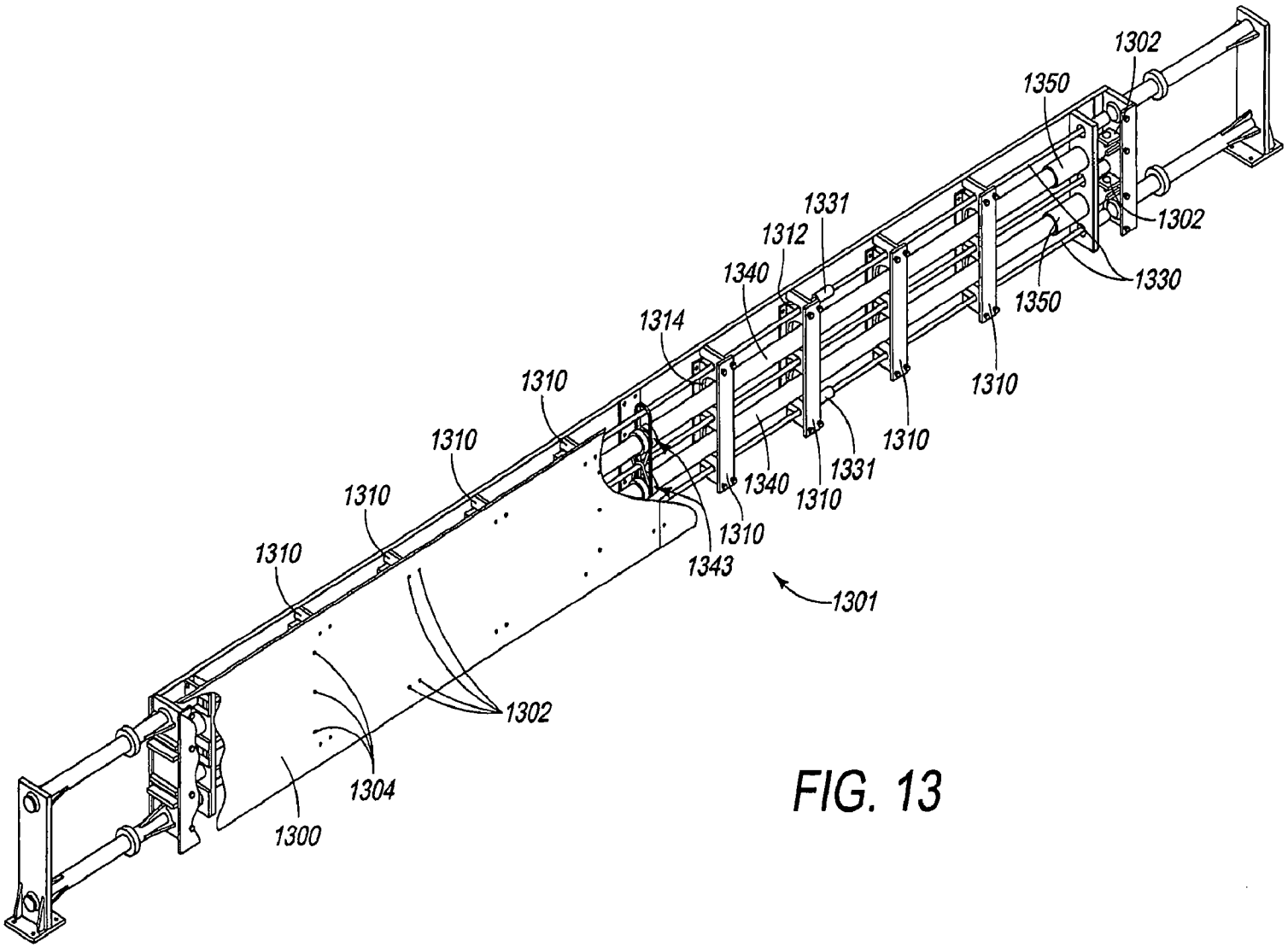
FIG. 13 is a perspective view of an alternative embodiment of the primary gate member of FIG. 4.
Figure 14:
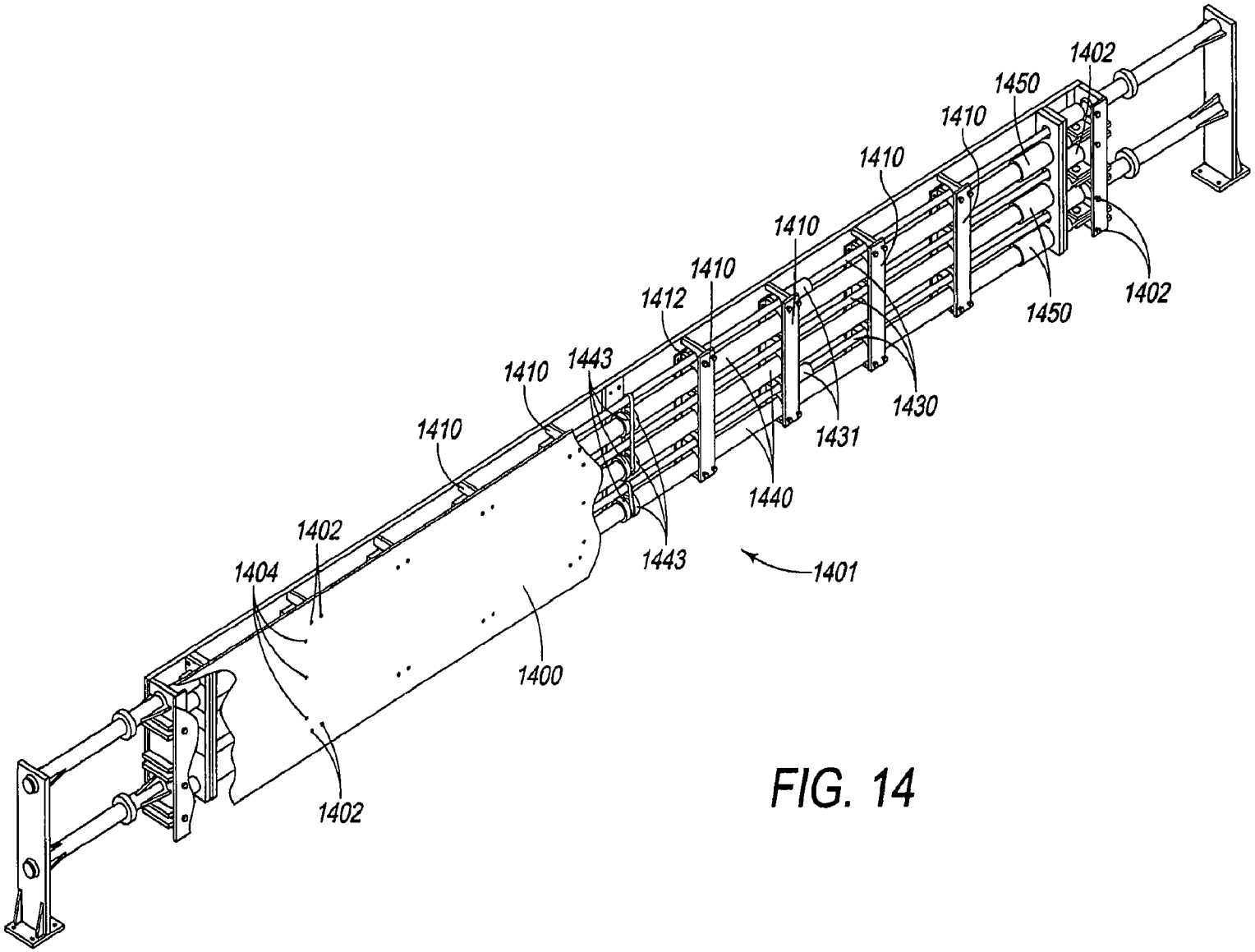
FIG. 14 is a perspective view of an alternative embodiment of the secondary gate member of FIG. 5.
Figure 15A:
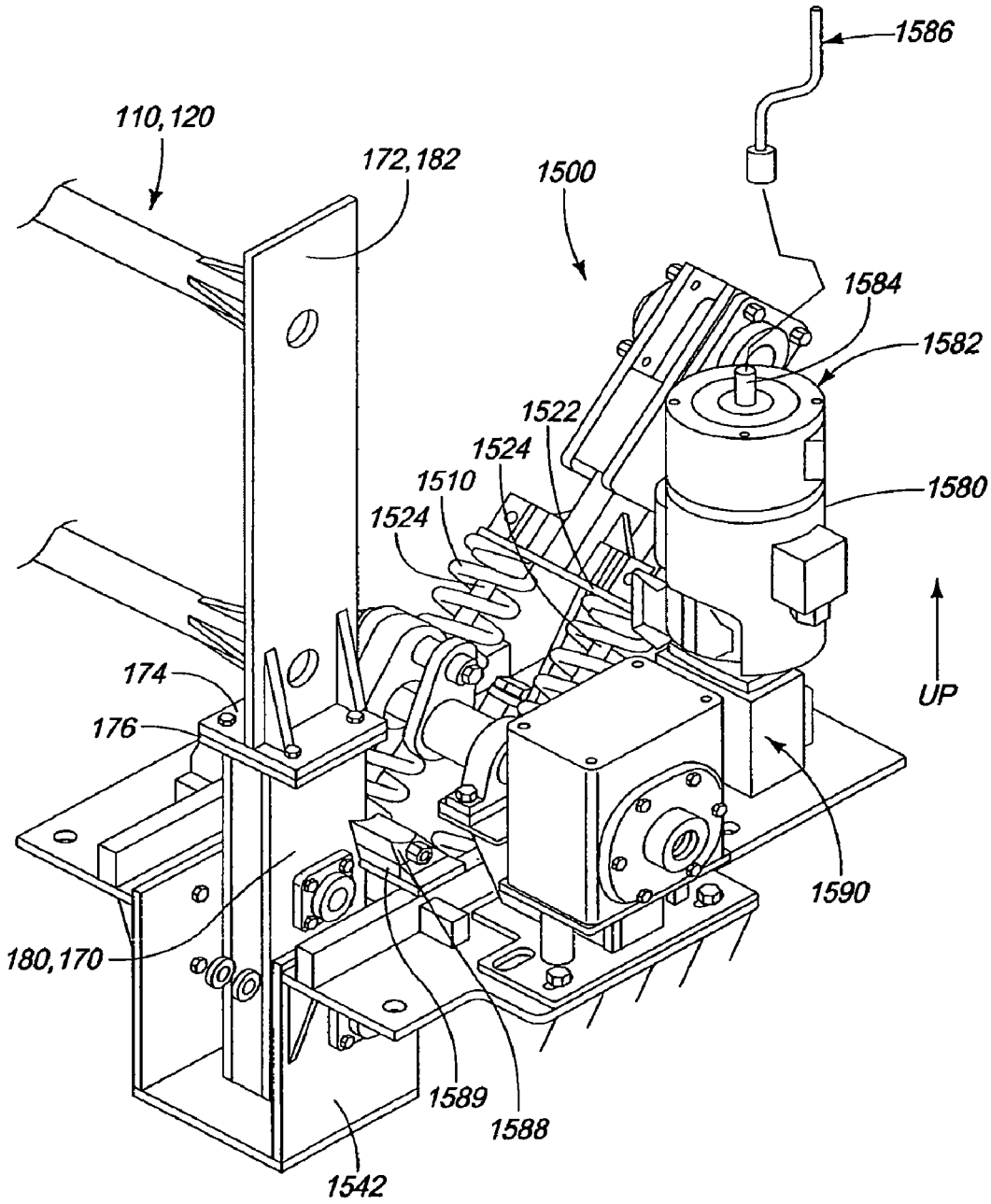
FIG. 15(*a*) is a perspective view of an alternative embodiment of a deployment assembly of the energy absorbing vehicle barrier of FIG. 1 in a deployed position.
Figure 15B:
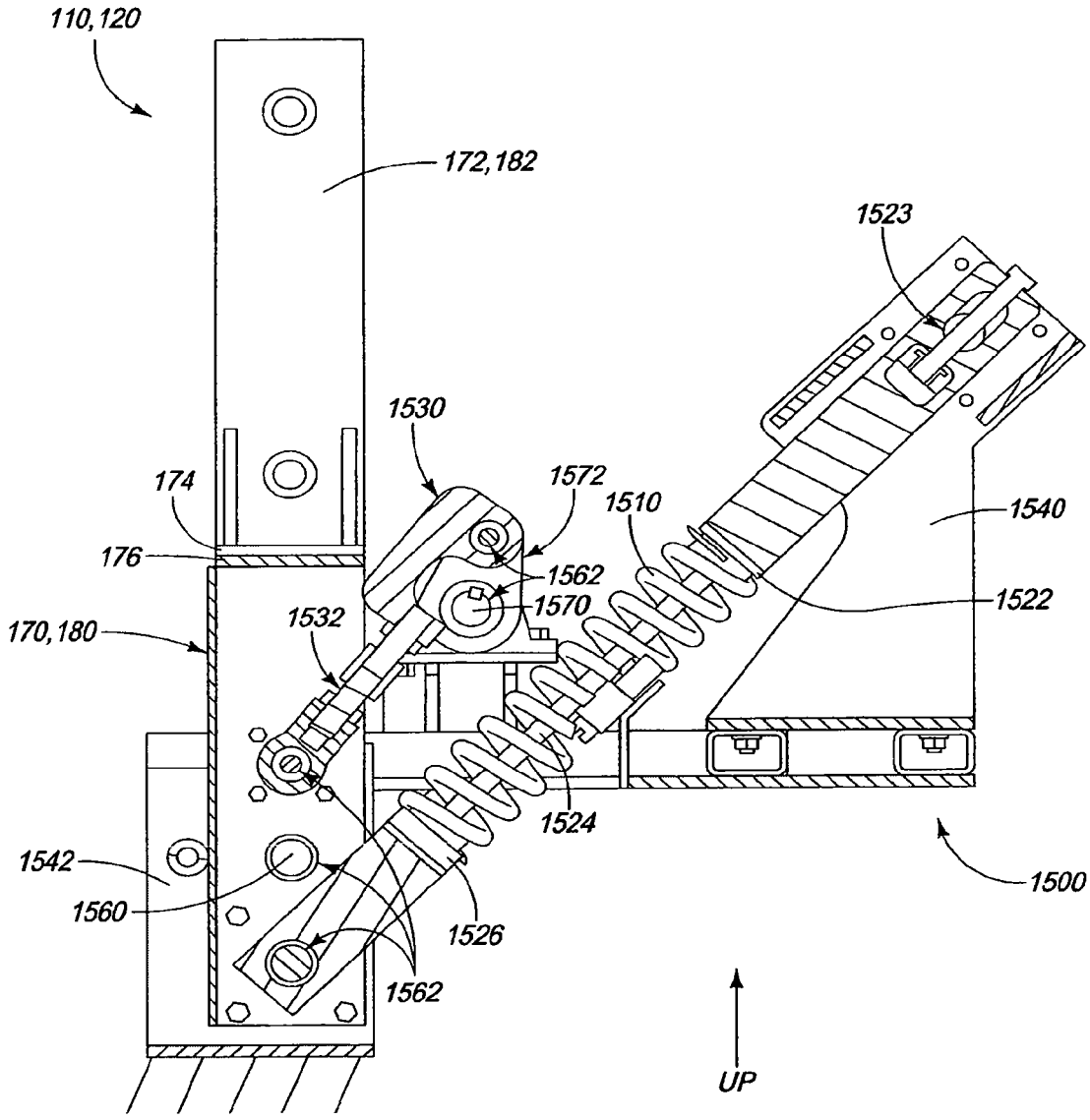
Figure 15C:
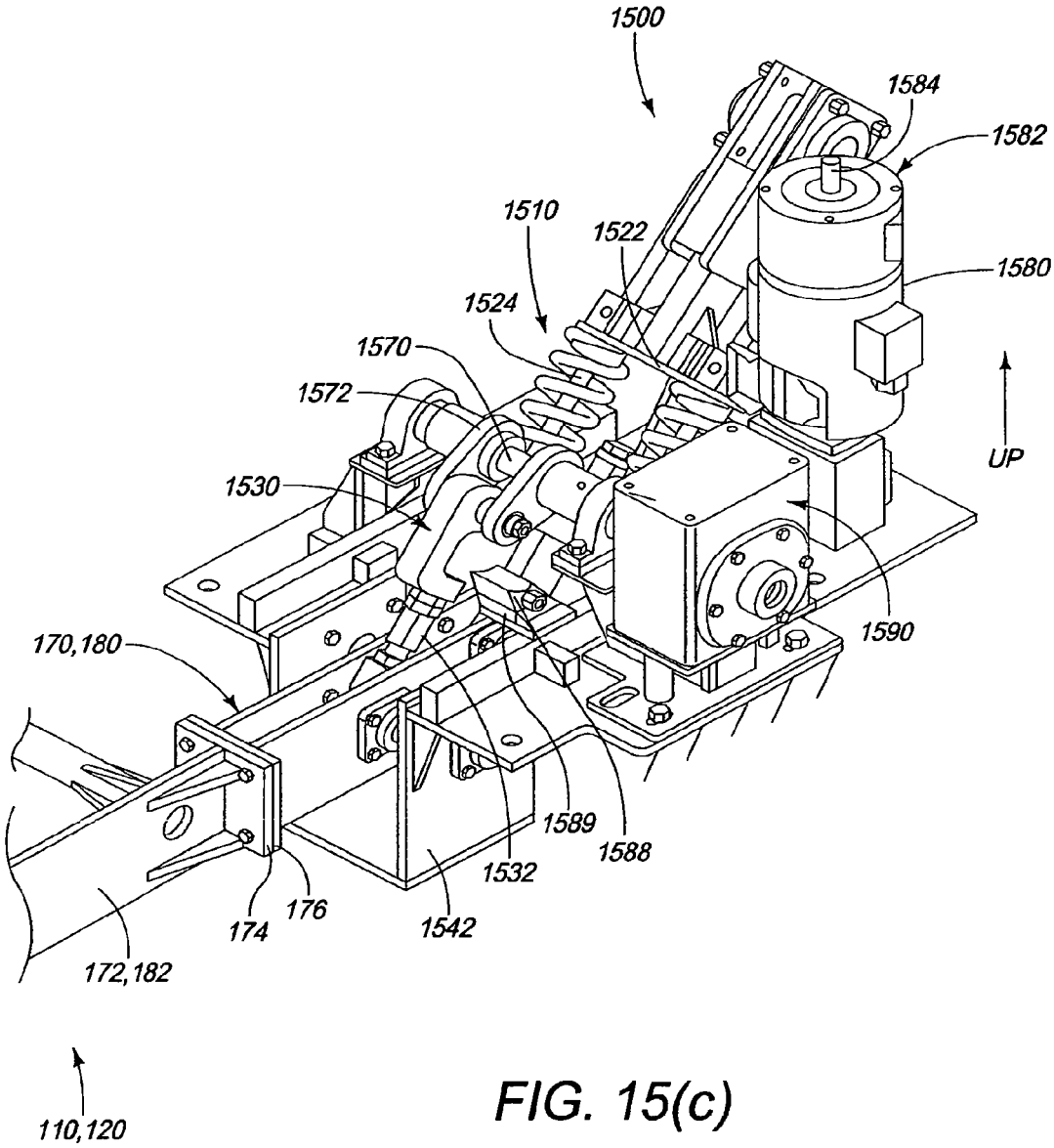
Figure 15D:
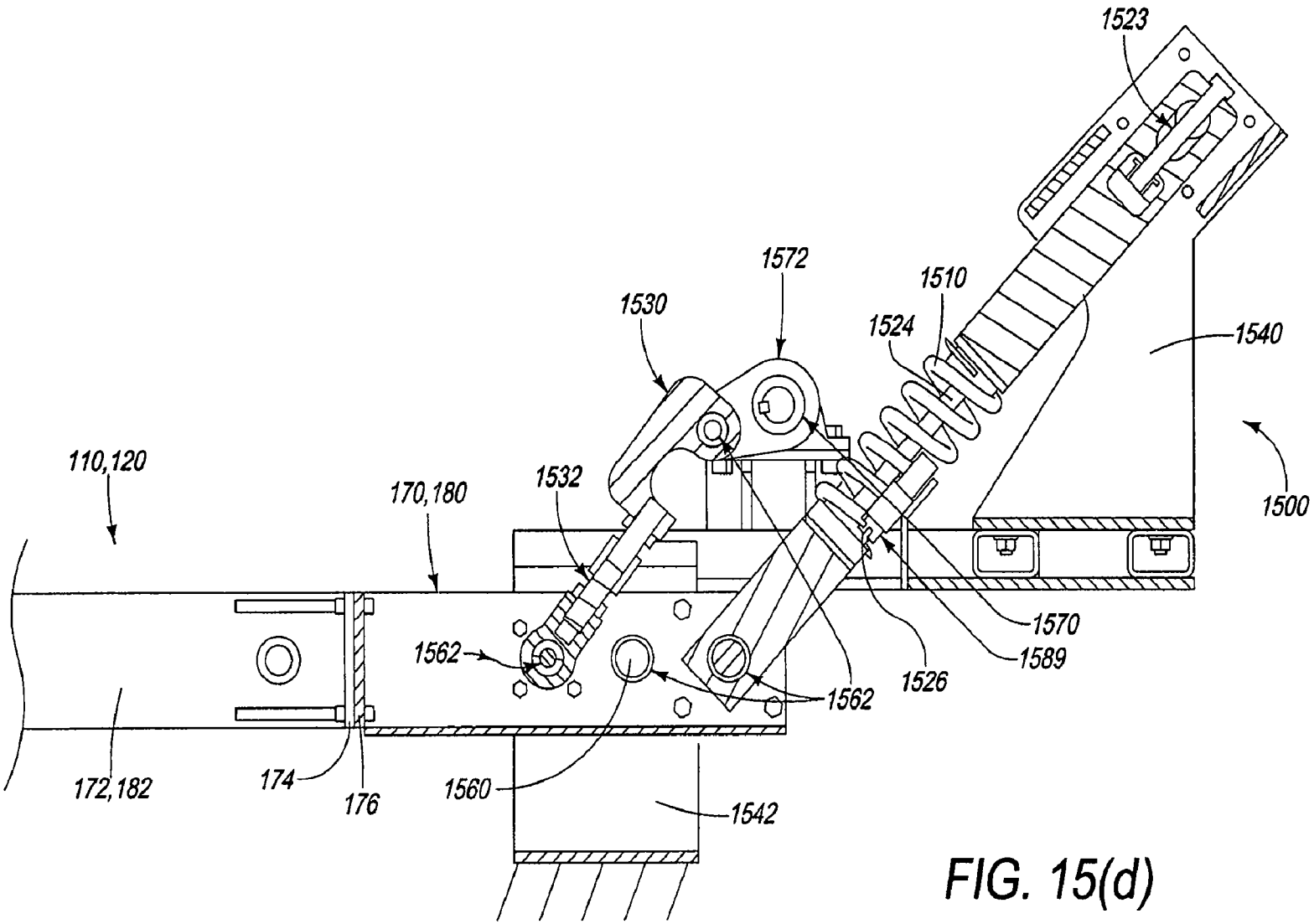

FIGS. 13 and 14 illustrate alternative embodiments of the primary and secondary gate members 110 and 120 of FIGS. 4 and 5, respectively. Referring to FIG. 13, the primary gate member 1301 includes covers 1300, fasteners 1302, shearable fasteners 1304, three vehicle retention tethers 1330, and two pairs of deformable energy absorbing members 1340. Each of the deformable energy absorbing members 1340 includes a stop 1343 disposed at or near its inboard end. The outboard ends of the deformable energy absorbing members 1340 of the gate member 1300 are attached to the deformable energy absorbing member anchor 1360 by a hinge member 1302 that is similar in both form and operation to the hinge member 1210 of FIG. 12. The deformable energy absorbing members 1340 may be attached to the hinge member 1302 by welding, or fasteners such as rivets, bolts, or the like.

The primary gate member 1301 preferably includes eight (8) spacing support members 1310 spaced apart from each other and disposed along the length of the primary gate member 1301. Each spacing support member 1310 preferably includes three tether notches 1312 and two receiver holes 1314. However, it should be understood that the primary gate member 1301 may include more or less than eight spacing support members 1310. Further, it should be understood that the primary gate member 1310 may include more than or less than three vehicle retention tethers 1330 or more or less than two pairs of deformable energy absorbing members 1340.

Additionally, the primary gate member 1301 includes at least four intermediate tether stops 1331 that are fixedly attached to the vehicle retention tethers 1330 by clamping, welding, or the like. Preferably the two intermediate tether stops 1331 are attached to the uppermost and lowermost vehicle retention tethers 1330, one on each side of the lateral center of the primary gate member 1301. The intermediate tether stops 1331 are preferably made of steel and are disposed slightly outboard of one of the spacing support members 1310. However, it should be understood that the intermediate tether stops 1331 may be located anywhere along the length of any of the vehicle retention tethers 1330.

In addition to restraining relative movement between the vehicle retention tethers 1330 and the deformable energy absorbing members 1340 during impact, the spacing support members 1310 also operate to support the covers 1300 from collapsing or permanently deforming under the weight of a vehicle 2 traveling over the primary vehicle barrier 10 in its retracted position. In this configuration the covers 1300 operate to transfer the load from the wheels of a vehicle 2 to the spacing support members 1310, which then transfer the load to the ground or other components of the foundation 102. Preferably, both the primary gate member 1301 and the secondary gate member 1401 (shown in FIG. 14) include eight (8) spacing support members 1310, 1410 thereby providing sufficient support to ensure that even large, heavy vehicles. For example, fully laden semi tractor-trailers driving over the primary and secondary gate members 1301, 1401 in the retracted position will not deform or damage the primary or secondary gate members 1301, 1401.

In operation, the primary gate member 1301 operates in substantially the same manner as described above with regard to the primary gate member 110 of FIGS. 4-4(*c*) when impacted by an unwanted or unauthorized vehicle 2. However, unlike primary gate member 110, when the primary gate member 1301 is impacted and the deformable energy absorbing members 1340 begin to deform, the intermediate tether stop 1331 contacts the spacing support member 1310 disposed inboard of the intermediate tether stop 1331. The intermediate tether stops 1331 operate to laterally balance deformation of the deformable energy absorbing members 1340 on both sides of the primary gate member 1301. For example, in the event the impacting vehicle 2 causes the deformable energy absorbing members 1340 to deform in an uneven manner, that is if the upper and lower deformable energy absorbing members 1340 disposed on one side of the lateral center of the primary gate member 1301 begin to deform before the upper and lower deformable energy absorbing members 1340 disposed on the opposite side of the lateral center of the primary gate member 1301, the intermediate tether stop 1331 disposed on the side experiencing deformation of the deformable energy absorbing members 1340 (deforming side) will contact the spacing support member 1310, thereby causing increased resistance on the deforming side. Because the intermediate tether stops 1331 cause the deforming side of the primary gate member 1301 to experience greater resistance than the non-deforming side, the deformable energy absorbing members 1340 on the non-deforming side of the primary gate member 1301 will begin to deform, thereby balancing the deformation of the deformable energy absorbing members 1340 in the lateral direction and ensuring more even energy absorption. Additionally, the intermediate tether stops 1331 may also cause the primary gate member 1301 to absorb additional energy through their interaction with other components during impact.

As the impact event progresses, the deformable energy absorbing members begin to hinge about the hinge member 1302 and deflect in a downstream direction and the inboard ends of the upper and lower pairs of deformable energy absorbing members 1340 begin to separate. As the deformable energy absorbing members 1340 continue to separate, the impact vehicle 2 will travel between the deformable energy absorbing members 1340 until the deforming collars 1350 contact the stops 1343.

Referring to FIG. 14, the secondary gate member 1401 includes substantially the same components arranged in substantially the same configuration and operates in the same manner as the primary gate member 1301. However, the secondary gate member 1401 includes an additional pair of deformable energy absorbing members 1440 and corresponding deforming collars 1450 and deforming members 1452.

Specifically, the secondary gate member 1401 includes two covers 1400, fasteners 1402, shearable fasteners 1404, three vehicle retention tethers 1430, and three pairs of deformable energy absorbing members 1440. Each of the deformable energy absorbing members 1440 includes a stop 1443 disposed at or near its inboard end. The secondary gate member 1401 preferably includes eight (8) spacing support members 1410 spaced apart from each other and disposed along the length of the secondary gate member 1401. Each spacing support member 1410 preferably includes three tether notches 1412 and three receiver holes 1414. However, as with primary gate member 1301, it should be understood that the secondary gate member 1401 may include more or less than eight spacing support members 1410, and more or less than three vehicle retention tethers 1430 or three pairs of deformable energy absorbing members 1440.

The secondary gate member 1401 also includes at least four intermediate tether stops 1431 that are fixedly attached to the vehicle retention tethers 1430. Preferably the intermediate tether stops 1431 are attached to the uppermost and lowermost vehicle retention tethers 1430, one on each side of the lateral center of the secondary gate member 1401. The intermediate tether stops 1431 are preferably made of steel and are disposed slightly outboard of one of the spacing support members 1410. However, it should be understood that the intermediate tether stops 1431 may be located anywhere along the length of any of the vehicle retention tethers 1430.

FIGS. 15(*a*)-(*b*) illustrate an alternative embodiment of the deployment assembly 150 of FIGS. 1 and 3 in a deployed position, while FIGS. 15(*c*)-(*d*) illustrate the alternative embodiment of the deployment assembly in a retracted position. As shown in FIGS. 15(*a*)-(*d*), the deployment assembly 1500 includes a pair of springs 1510, a pair of guides 1524, a spring anchor 1526, a top plate 1522, a pre-compression adjuster 1523, a motor 1580, a crank assembly 1572, and a non-adjustable linkage assembly 1530, an adjustable linkage assembly 1532, a gear box 1590, and an axle 1560. The motor 1580 is directly connected to a motor brake 1582 and includes an auxiliary shaft 1584 disposed at the axial center of the motor 1530 and extending vertically above the top of a housing for the motor brake 1582.

Note that the two primary gate deployment assemblies 1500 for the primary barrier assembly 10 are identical in components and function, but are assembled in a mirror image configuration. Furthermore, the two secondary gate deployment assemblies for the secondary barrier assembly 20 include substantially the same components and function in the same manner as the primary gate deployment assembly 1500 shown in FIGS. 15(*a*)-(*d*).

As with the primary and secondary gate deployment assemblies 150 of FIG. 3, the primary and secondary gate deployment assemblies 1500 are disposed adjacent to the outboard side of the base of the primary and secondary gate receivers 130, 140, and may be disposed above the surface of the foundation 102. Alternatively, the deployment assemblies 1500 may be disposed below the surface of the foundation 102, and may be disposed within the primary or secondary gate recesses 190, 192. A spring support member 1540 may abut, or be attached to the outward facing surface of each of the primary and secondary gate receivers 130, 140.

As shown in FIGS. 15(*a*)-(*d*), two guides 1524 made of steel rod are inserted through apertures in the top plate assembly 1522 and fixedly attached to a spring anchor assembly 1526. The guides 1524 slide through linear bearings housed in the top plate assembly 1522. The spring anchor assembly 1526 is rotatably coupled to the lower gate support member 170, 180 below the axle 1560 by one or more bearings 1562. A spring 1510 is disposed around each of the guides 1524 and is compressed between an upper surface of the spring anchor assembly 1526 and a lower surface of the top plate assembly 1522. Preferably, the springs are 350 pounds/inch steel springs for the primary gate and 400 pounds/inch steel springs for the secondary gate. The top plate assembly 1522 is rotatably connected to a support member 1540 by a pre-compression adjuster assembly 1523 that threadably engages a shaft in the top plate assembly 1522. In operation, when a threaded fastener (e.g. a bolt or a screw) of the pre-compression adjuster 1530 is rotated, the pre-compression adjuster 1523 moves the top plate assembly 1522 toward or away from the spring anchor assembly 1526, depending on the direction of rotation, thereby increasing or decreasing the amount of pre-compressive force exerted on each spring 1510.

The electric motor 1580 is directly attached to the motor brake 1582 and the gear box 1590. Preferably, the electric motor is a 1 HP (horsepower) motor that is capable of operating at 1750 RPM (revolutions per minute). The gear box 1590 preferably has a 100:1 gearing ratio, and is mechanically coupled to a crank shaft 1570. However, it should be understood that this embodiment is not limited thereto, and any motor and gearbox combination that is capable of deploying the primary and secondary barrier assemblies 10, 20 within 5 seconds, or more preferably, within 2 seconds may be utilized.

The crank shaft 1570 is fixedly coupled to a crank assembly 1572 having two crank arms that extend radially outward from, and are disposed in a longitudinally central location of the crank shaft 1570. The crank arms of the crank assembly 1572 are rotatably coupled through bearings 1562 to a non-adjustable linkage assembly 1530. The non-adjustable linkage assembly 1530 preferably includes a cut-away, or bent portion that substantially corresponds to the shape of the crank shaft 1570, thereby allowing the crank assembly 1572 to rotate up to 180 degrees and preventing the non-adjustable linkage assembly 1530 from contacting or interfering with the crank shaft 1570 during operation. The adjustable linkage assembly 1532 is comprised of a middle portion that is threaded into upper and lower end portions that contain bearings. The upper end portion is rotatably coupled to the non-adjustable linkage assembly 1530, while the lower end portion is rotatably coupled to the lower gate support member 170, 180 above the axle 1560 by one or more bearings 1562. The upper and lower end portions are preferably attached to the middle portion using opposite direction threads. For example, the upper end portion may be attached to the middle portion with right-hand threads, while the lower end portion may be attached using left-hand threads. In this arrangement, if the middle portion is rotated the entire adjustable linkage assembly 1532 becomes longer or shorter, depending on the direction of rotation. The adjustable linkage assembly 1532 is configured to adjust in length so as to ensure that the primary and secondary barrier assemblies 10, 20 rotate properly between the deployed and retracted positions.

The lower gate support member 170, 180 is preferably rotatably coupled to the axle 1560 through bearings 1562. The bearings 1562 themselves may be any type of bearing known in the art, including for example and without limitation, bushings, ball bearings or needle bearings. The axle 1560 passes through a tube in the lower gate support member 170, 180 and is fixed in place relative to the tube/lower gate support member 170, 180 by set screws. Preferably the axle 1560 is rotatably attached to bearings 1562 that are fixedly attached to the base 1542. Each of the lower support members 170, 180 is detachably attached to one of the upper primary or secondary gate support members 172, 182 by welding or fastening the mounting plate 176, disposed at an upper end of the lower support members 170, 180, to the mounting plate 174, disposed at the lower end of the upper primary or secondary gate support members 172, 182, thereby connecting the lower support members 170, 180 to the primary or secondary gate members 110, 120.

In operation, when the motor 1580 is activated, the motor 1580 turns the gear box 1590, which in turn rotates the crank shaft 1570 at a 100:1 ratio. Preferably, the motor 1580 operates at a constant speed of 1750 RPM. As the crank shaft 1570 turns, it rotates the crank assemblies 1572, which moves the linkage assembly 1530 and the attached adjustable linkage assembly 1532. Because the adjustable linkage assembly 1532 is rotatably attached to the lower support member 170, 180, as the adjustable linkage assembly is moved it forces the lower support member 170, 180 to and axle 1560 to rotate about the bearings in base 1542. In a preferred embodiment, the crank assembly 1572 and the linkage assemblies 1530, 1532 are configured to move the lower support members 170, 180, and therefore the primary and secondary barrier assemblies 10, 20 between the retracted and deployed positions by moving the crank assembly from about 150 to 180 degrees. However, it should be understood that the crank assembly 1572 may be configured to move the primary and secondary barrier assemblies 10, 20 between the deployed and retracted positions in less than 150 degrees.

If the motor 1580 is operating at maximum speed, the deployment assembly 1500 is capable of raising or lowering the primary/secondary barrier assemblies 10, 20 in 1.43 seconds for crank assemblies 1572 designed to move 150 degrees, and 1.71 seconds for crank assemblies 1572 designed to move 180 degrees. Further, the crank assembly 1572 and the adjustable and non-adjustable linkage assemblies 1530, 1532 are configured such that even when the crank shaft 1570 is rotated by the motor 1580 through the gear box 1590 at a constant speed, the lower support member 170, 180 is rotated at a non-constant speed. Specifically, the crank assembly 1572 and the adjustable and non-adjustable linkage assemblies 1530, 1532 are configured such that the lower support member 170, 180 rotates slowly through an initial range, then increases in speed in an intermediate range, and then slows again before the motor 1580 is stopped by the motor brake 1582. The motor brake 1582 is configured to automatically disengage when power is supplied to the motor 1580. Preferably, the motor brake 1582 is also configured to re-engage when the lower support member 170, 180 contacts 1) a first limit switch 1588 that indicates when the primary or secondary barrier assembly 10, 20 is in the fully deployed position, or 2) a second limit switch 1589 that indicates when the primary or secondary barrier assembly 10, 20 is in the fully retracted position.

As shown in FIGS. 15(*c*) and (*d*), when the primary or secondary barrier assemblies 10, 20 are moved from the deployed position to the retracted position, the center of gravity of the primary and secondary barrier assemblies 10, moves increasingly farther away from the axle 1560, thereby increasing the amount of torque (moment) about the axle 1560. This increase in torque causes an increase in the amount of force applied to the non-adjustable and adjustable linkage assemblies 1530, 1532. As the primary and secondary barrier assemblies 10, 20 rotate about the axle 1560 from the deployed position to the retracted position, the lower support member 170, 180 rotates upward, which causes the spring anchor assembly 1526 to move toward the top plate assembly 1522. This movement of the spring anchor assembly 1526 forces the free ends (upper ends) of the guides to slide through the apertures in the top plate assembly 1522, and causes the springs 1510 to compress, thereby storing energy and at least partially offsetting some of the torque applied to the motor 1580. Thus, the compressed springs 1510 act as a counterbalance to the primary and secondary barrier assemblies 10, 20. In general, the increased torque caused by the primary and secondary barrier assemblies 10, 20 being lowered does not pose problems during retraction, since the torque is increasing in the direction the motor 1580 is rotating and the increasing toque is offset by the counterbalancing of the springs.

In contrast, when moving the primary and secondary barrier assemblies 10, 20 from the retracted position to the deployed position, this increased torque actually increases the amount of force required by the motor 1580 to raise the primary and secondary gate members 10, 20. To help reduce the force required to raise the primary or secondary gate assemblies 10, 20 (and reduce the amount of force on the non-adjustable and adjustable linkage assemblies 1530, 1532) the springs 1510 apply a force to the lower support member 170, 180 below the axle 1560 at the pivot point 1562. The degree of counterbalance support provided by the springs 1510 can be adjusted by either adjusting the amount of pre-compression on the springs 1510 through the pre-compression adjuster 1523 or by exchanging the springs 1510 for springs having lower or higher force characteristics.

As with the winch mechanism of FIG. 3, the primary and secondary barrier assemblies 10, 20 may be activated remotely as desired by a button, or switch or the like. The primary and secondary barrier assemblies 10, 20 may also be deployed using sensors that detect the presence of an oncoming vehicle. A microprocessor based system may then determine when to retract or deploy the primary and secondary barrier assemblies 10, 20 based on a predetermined sensory threshold. In the event of a power outage or a control system failure, the primary and secondary barrier assemblies 10, 20 may be deployed or retracted manually by manually releasing the motor brake and attaching a hand crank 1586 shown in FIG. 15(*a*) to the auxiliary shaft 1584 and rotating the hand crank 1586. Note that manual retraction or deployment of the barrier assemblies 10, 20 in this manner is only possible because the springs 1510 help counterbalance the weight of the primary and secondary barrier assemblies 10, 20.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. An energy absorbing vehicle barrier comprising:

a gate member disposed between first and second gate receivers and deformable from a pre-impact configuration to an impact configuration, wherein said gate member comprises:

a first deformable energy absorption member having a first end coupled to said first gate receiver and a second end extending inward toward a center of said gate member;

a second deformable energy absorption member having a first end coupled to said second gate receiver and a second end extending inward toward said center of said gate member; and a deforming member connecting said first and second deformable energy absorption members in an overlapping configuration, wherein said deforming member is configured to engage and deform said first and second deformable energy absorption members as said gate member is deformed from said pre-impact configuration to said impact configuration.

2. The energy absorbing vehicle barrier of claim 1, further comprising a tether disposed within said first and second deformable energy absorption members and having a first end coupled to said first gate receiver and a second end coupled to said second gate receiver, wherein said tether is configured to limit the deformation of said gate member.

3. The energy absorbing vehicle barrier of claim 1, wherein at least one of said first and second deformable energy absorption members is a metal tube having a circular cross-section.

4. The energy absorbing vehicle barrier of claim 1, wherein at least one of said first and second deformable energy absorption members is a metal tube having a quadrilateral cross-section.

5. The energy absorbing vehicle barrier of claim 1 wherein said deforming member comprises a tube.

6. The energy absorbing vehicle barrier of claim 5 wherein said deforming member comprises at least one deforming component extending inwardly into said interior of said tube and into engagement with at least one of said first and second deformable members.

7. The energy absorbing vehicle barrier of claim 6 wherein said deforming member comprises at least first and second deforming components spaced apart along said deforming member and engaging respectively said first and second deformable members.

8. The energy absorbing vehicle barrier of claim 1 further comprising a lock member releasably locking said deforming member and at least one of said first and second deformable members.

9. The energy absorbing vehicle barrier of claim 8 wherein said lock member comprises a lock pin extending through said deforming member and said at least one of said first and second deformable members.

10. The energy absorbing vehicle barrier of claim 1 wherein said first end of each of said first and second deformable members comprises an anchor plate.

11. The energy absorbing vehicle barrier of claim 6, wherein said first and second deforming tubes and said deformable energy absorption member have a quadrilateral cross-section.

12. An energy absorbing vehicle barrier comprising:

a gate member disposed between first and second gate receivers and deformable from a pre-impact configuration to an impact configuration, wherein said gate member comprises:

a first deforming tube having a first end coupled to said first gate receiver and a second end extending inward toward a center of said gate member;

a second deforming tube having a first end coupled to said second gate receiver and a second end extending inward toward said center of said gate member; and a deformable energy absorption member connecting said first and second deforming tubes in an overlapping configuration, wherein, said first and second deforming tubes comprise deforming members configured to engage and deform said deformable energy absorption member as said gate member is deformed from said pre-impact configuration to said impact configuration.

13. The energy absorbing vehicle barrier of claim 12, further comprising a tether disposed within said first and second deforming tubes and said deformable energy absorption member, said tether having a first end coupled to said first gate receiver and a second end coupled to said second gate receiver, wherein said tether is configured to limit the deformation of said gate member.

14. The energy absorbing vehicle barrier of claim 13, wherein said first and second deforming tubes and said deformable energy absorption member have a circular cross-section.

15. The energy absorbing vehicle barrier of claim 12 wherein each of said first and second deforming tubes comprises at least one deforming component extending inwardly into said interior of respective first and second deforming tube and into engagement with said deformable energy absorption member.

16. The energy absorbing vehicle barrier of claim 15 wherein each of said first and second deforming tubes comprises a plurality of deforming components engaging respectively said deformable energy absorption member.

17. The energy absorbing vehicle barrier of claim 12 further comprising a lock member releasably locking at least one of said first and second deforming tubes and said deformable energy absorption member.

18. The energy absorbing vehicle barrier of claim 17 wherein said lock member comprises a lock pin extending through said at least one of said first and second deforming tubes and said deformable energy absorption member.

19. The energy absorbing vehicle barrier of claim 12 wherein said first end of each of said first and second deforming tubes comprises an anchor plate.

* * * * *